US008624138B2

(12) United States Patent
Scola et al.

(10) Patent No.: US 8,624,138 B2
(45) Date of Patent: Jan. 7, 2014

(54) CIRCUIT-BREAKING DEVICE FOR LOW-VOLTAGE SYSTEMS

(75) Inventors: Edoardo Scola, Lecco (IT); Michele Ferrari, Bergamo (IT)

(73) Assignee: ABB S.p.A., Milan (IT)

( * ) Notice: Subject to any disclaimer, the term of this patent is extended or adjusted under 35 U.S.C. 154(b) by 261 days.

(21) Appl. No.: 13/142,728

(22) PCT Filed: Dec. 29, 2009

(86) PCT No.: PCT/EP2009/067995

§ 371 (c)(1),
(2), (4) Date: Jun. 29, 2011

(87) PCT Pub. No.: WO2010/079105

PCT Pub. Date: Jul. 15, 2010

(65) Prior Publication Data

US 2011/0272259 A1 Nov. 10, 2011

(30) Foreign Application Priority Data

Jan. 8, 2009 (IT) ..... MI2009A0010

(51) Int. Cl.

| | |
|---|---|
| ***H01H 1/64*** | (2006.01) |
| ***H01H 1/66*** | (2006.01) |
| ***H01H 9/02*** | (2006.01) |
| ***H01H 9/06*** | (2006.01) |
| ***H01H 13/00*** | (2006.01) |
| ***H01H 19/04*** | (2006.01) |
| ***H01H 19/08*** | (2006.01) |
| ***H01H 21/00*** | (2006.01) |

(52) U.S. Cl.
USPC ..... 200/293

(58) Field of Classification Search
USPC ..... 200/293, 296, 297, 5 R, 5 B, 5 C, 6 R, 200/19.18, 19.2, 19.22, 19.27, 19.3, 49, 200/553, 558, 339
See application file for complete search history.

(56) References Cited

U.S. PATENT DOCUMENTS 4,129,762 A * 12/1978 Bruchet ..... 200/401
4,622,530 A * 11/1986 Ciarcia et al. ..... 335/167
5,362,933 A * 11/1994 Kutsche et al. ..... 200/401

(Continued)

FOREIGN PATENT DOCUMENTS

CN 1166889 A 12/1997
CN 1340838 A 3/2002

(Continued)

OTHER PUBLICATIONS

Chinese Office Action dated May 7, 2013.

*Primary Examiner* — Edwin A. Leon
*Assistant Examiner* — Anthony R. Jimenez
(74) *Attorney, Agent, or Firm* — Novak Druce Connolly Bove + Quigg LLP

(57) ABSTRACT

The present invention relates to a circuit-breaking device for low-voltage systems with a control mechanism that has improved characteristics of compact size and reliability. The circuit-breaking device according to the invention comprises an outer housing containing, for each pole, at least one fixed contact and at least one moving contact suitable for being mutually coupled and uncoupled. The device also comprises a control mechanism comprising a supporting frame that supports a kinematic chain operatively connected to the moving contact so as to enable the latter to be coupled to or uncoupled from the fixed contact. The supporting frame comprises a pair of sides connected by means of a first transverse connecting portion and by further connection means that define a further transverse connecting portion in a different position from that of the first transverse connecting portion.

9 Claims, 19 Drawing Sheets

(56) References Cited

U.S. PATENT DOCUMENTS

| | | | | |
|---|---|---|---|---|
| 5,794,763 | A * | 8/1998 | Ogasawara | 200/401 |
| 6,249,197 | B1 * | 6/2001 | Zindler et al. | 335/202 |
| 6,466,117 | B2 * | 10/2002 | Castonguay et al. | 335/172 |

FOREIGN PATENT DOCUMENTS

| | | |
|---|---|---|
| CN | 1372696 A | 10/2002 |
| DE | 4442417 | 2/1996 |
| WO | WO-0165584 | 9/2001 |

* cited by examiner

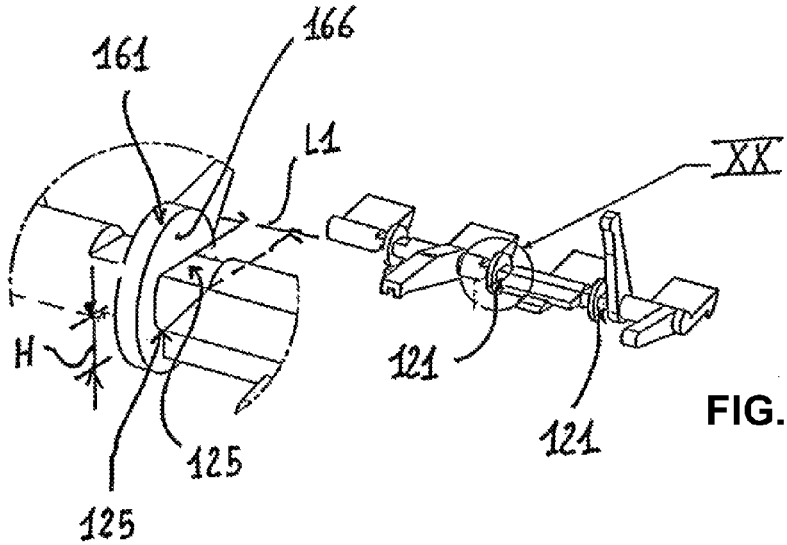
FIG. 20
FIG. 18
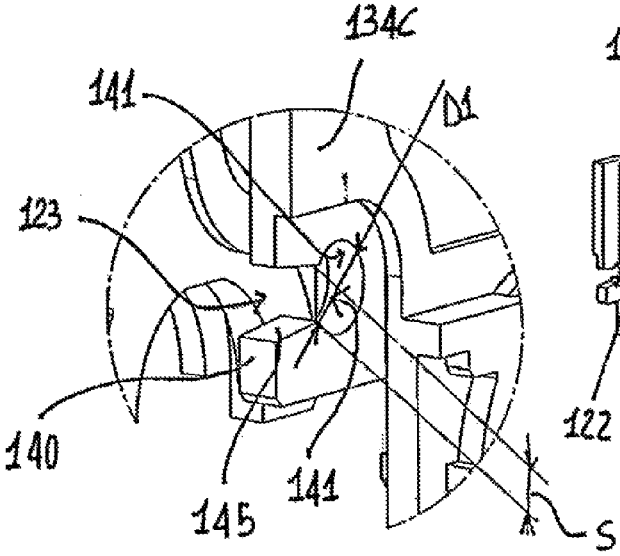
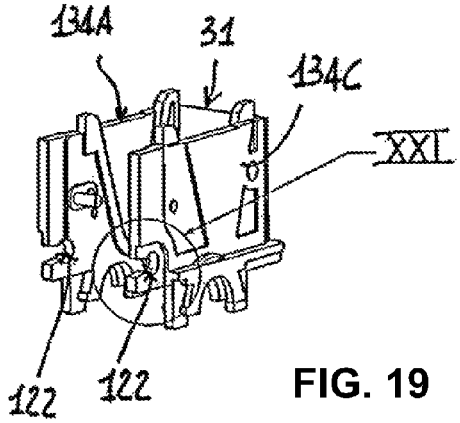
FIG. 19
FIG. 21

CIRCUIT-BREAKING DEVICE FOR LOW-VOLTAGE SYSTEMS

CROSS REFERENCE TO RELATED APPLICATIONS

This application is a National Phase filing under 35 U.S.C. §371 of PCT/EP2009/067995 filed on Dec. 29, 2009; and this application claims priority to Application No. MI2009A000010 filed in Italy on Jan. 8, 2009 under 35 U.S.C. §119; the entire contents of all are hereby incorporated by reference.

DESCRIPTION

The present invention relates to a circuit-breaking device for low-voltage systems with a control mechanism with improved characteristics of compact size and reliability.

It is common knowledge that low-voltage circuit-breaking devices (i.e. for applications with working voltages up to 1000V AC/1500V DC), such as automatic circuit breakers, isolators and contactors, generally called "switching devices", and hereinafter called circuit breakers for the sake of simplicity, are devices designed to enable the proper operation of specific parts of electric systems and the installed loads. Automatic circuit breakers, for instance, ensure that the required rated current can flow towards the various users, enabling the loads to be reliably connected to and disconnected from the circuit, and also enabling the circuit being protected to be automatically isolated from the electrical energy source.

It is also well known that circuit breakers comprise a housing and one or more electric poles, each of which is associated with at least one pair of contacts that can be mutually coupled and uncoupled, and a control mechanism that induces a relative movement between the pairs of contacts. The action of the control mechanism on the moving contacts is conventionally achieved by means of a main shaft operatively connected to the moving contacts, or by means of a moving part operatively supporting the contacts. The control mechanism conventionally comprises a supporting frame that supports a kinematic chain that consists of at least one element operatively connected to the moving part and enabling its displacement.

The control mechanisms usually comprise at least one tripping element that is generally operated by a protection device in the event of an anomaly, such as a short circuit, occurring in the circuit in which the circuit breaker is installed. The protection device may be of the thermal, thermomagnetic or electronic type, for instance, and it directly or indirectly activates the kinematic chain of the control mechanism to induce a rapid separation of the contacts and a consequent automatic opening of the circuit breaker.

The kinematic chains in conventional control mechanisms consist of a plurality of operative members, at least one of which is connected to the frame by means of a hinged joint consisting of a through pin that connects the sides of the frame together. In almost all cases, the mutual connection between the other elements in the kinematic chain is also achieved in a like manner by means of hinged joints complete with pins.

In the known solutions, one of the most crucial aspects from the point of view of the manufacturing costs concerns the procedure for assembling the circuit breaker. In the majority of cases, the components are assembled "in-line", i.e. one after the other, according to a logic that obviously depends on the structure of the circuit breaker. The assembly times are determined particularly by the structure of the control mechanism, which comprises a large number of components of relatively small dimensions. Hence the need to develop new technical solutions that enable an evident reduction in the current assembly times by substantially simplifying said procedure.

Based on these considerations, the main aim of the present invention is to produce a circuit-breaking device for low-voltage systems that enables the above-mentioned drawbacks to be overcome, and particularly that gives rise to shorter assembly times than those of the known solutions.

This aim is achieved by a circuit-breaking device according to the content of claim 1 and of the dependent claims.

The description below refers, exclusively for descriptive purposes, to a single-switching multipolar circuit-breaking device for low-voltage systems. This is obviously on the understanding that the principles and technical solutions expounded in the description of the inventive concept are also applicable to other types of circuit-breaking device, such as double-switching circuit breakers with a different number of poles.

Further characteristics and advantages will emerge more clearly from the description of a preferred, but not exclusive, embodiment of the circuit breaker according to the present invention, illustrated in a non-limiting example in the attached drawings, wherein:

FIG. 18 is a perspective view showing the trip shaft of the device illustrated in figures from 13 to 16;

FIG. 19 is a perspective view relating to the supporting frame of the control mechanism in the device illustrated in figures from FIGS. 13 to 16;

FIGS. 20 and 21 are detailed views respectively showing the details XX and XXI of FIGS. 18 and 19;

Figure 26:
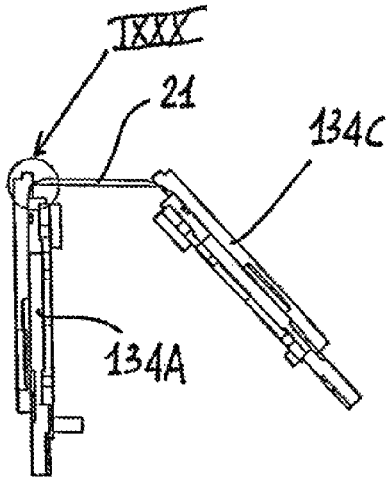
Figure 29:
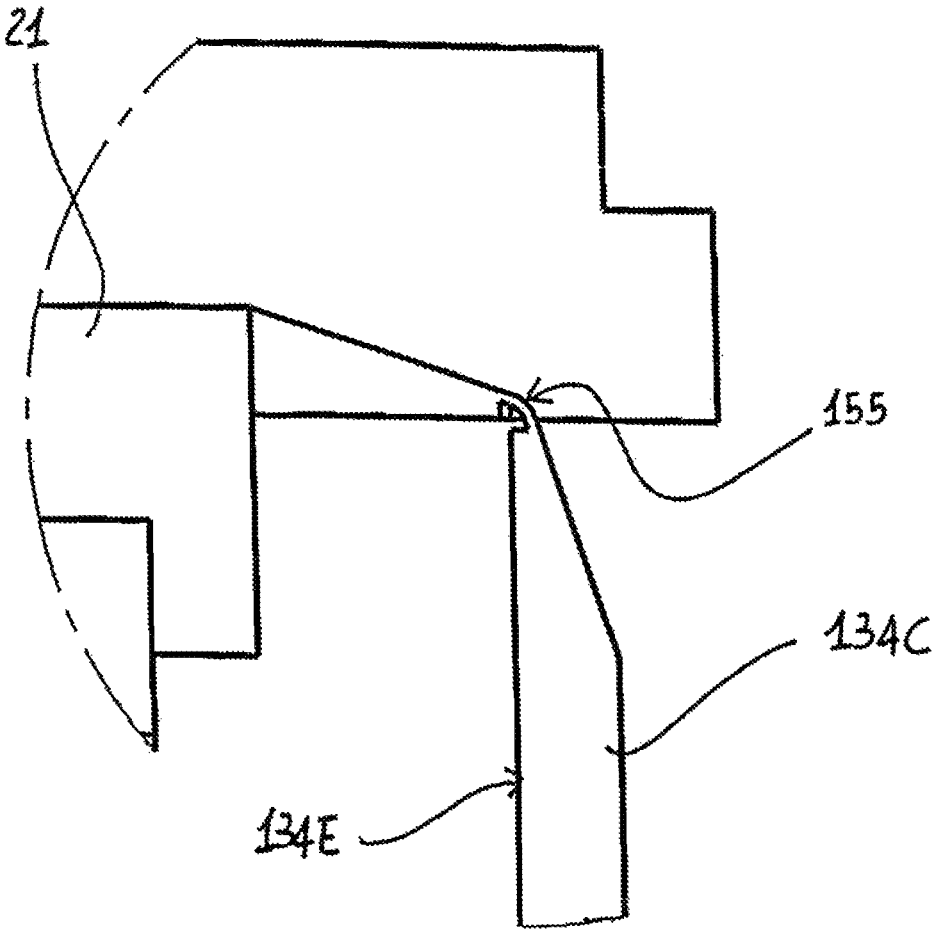

figures from FIGS. 25 to 28 relate to the assembly stages of the control mechanism of the circuit-breaking device illustrated in figures from FIGS. 13 to 16;

FIG. 29 is a detailed view of a portion of the supporting frame shown in FIG. 26.

With reference to the above-mentioned figures, the circuit-breaking device 1 according to the present invention comprises an outer housing 2 containing, for each pole, at least one fixed contact 10 and at least one moving contact 20, suitable for being mutually coupled or uncoupled. The circuit-breaking device 1 comprises a control mechanism 30 that is operatively connected to said at least one moving contact 20 to enable the latter's displacement between a coupled position and an uncoupled position with respect to the corresponding fixed contact 10. The control mechanism 30 comprises a supporting frame 31 that supports a kinematic chain operatively connected to the moving contact 20 by means of a moving part 50 that enables it to be coupled to or uncoupled from said fixed contact 10.

The circuit-breaking device 1 comprises a tripping device provided with a trip shaft 40 that interacts with said control mechanism 30 to enable the kinematic chain and thereby trigger the uncoupling of the moving contact 20 from the fixed contact 10. The control mechanism 30 comprises a plurality of elements 31,32,33,34,35,36 (see FIG. 7, for instance) that are operatively connected to define at least one kinematic chain, which takes effect on the moving contacts 20 by means of the moving part 50. For the purposes of the present invention, the term kinematic chain is used to indicate a set of elements in the control mechanism that are coupled together to perform one of the functions (e.g. a manual or automatic circuit opening) for which the mechanism was conceived. This means that there may be several kinematic chains in the control mechanism, each designed for instance to perform one of these functions.

The supporting frame 31 advantageously comprises a pair of facing sides 134 mutually connected by means of a first transverse connecting portion 21. According to the invention, the sides 134 are mutually connected by means of further connection means that define a further transverse connecting portion in a different position from the one occupied by the first transverse connecting portion 21. In this embodiment, in other words, the sides 134 of the frame are mutually attached in two places so that they maintain a stable position in relation to one another. This means that the elements of the kinematic chain also permanently maintain their operative positions between the sides 134 of the frame.

According to a preferred embodiment of the invention, these transverse connecting means connect the two sides 134 together so that the additional connecting portion extends in a position substantially in front of that of the first transverse connecting portion 21. This solution ensures a stable and reliable connection between the sides 134, guaranteeing the structural stability of the supporting frame 31 needed for the proper operation of the control mechanism 30. Moreover, the solution described has also proved particularly advantageous from the point of view of the assembly of the circuit-breaking device 1, since the control mechanism 30 can be assembled separately from the rest of the circuit breaker 1, and inserted therein only at the end of the procedure. In practice, the opportunity to assemble the control mechanism 30 before assembling the circuit breaker 1 enables savings in terms of the device's manufacturing times and costs.

According to a preferred embodiment of the invention, these connection means consist of the trip shaft 40 of the tripping device of the circuit breaker 1. More precisely, the sides of the supporting frame 31 are pivotally connected to the trip shaft 40. As a consequence, the unit consisting of the trip shaft 40 and the control mechanism 30 can be assembled simultaneously inside the circuit-breaking device 1, since the positioning of the former determines that of the other. Said unit can also be assembled on a different line from that of the circuit-breaking device 1, prior to the assembly of the latter.

Using the trip shaft 40 as a means of connection between the sides proves particularly advantageous because the structure of a member conventionally designed to serve a precise purpose (that of tripping the kinematic chain) is used to serve a further structural purpose for the frame 31.

Figure 1:
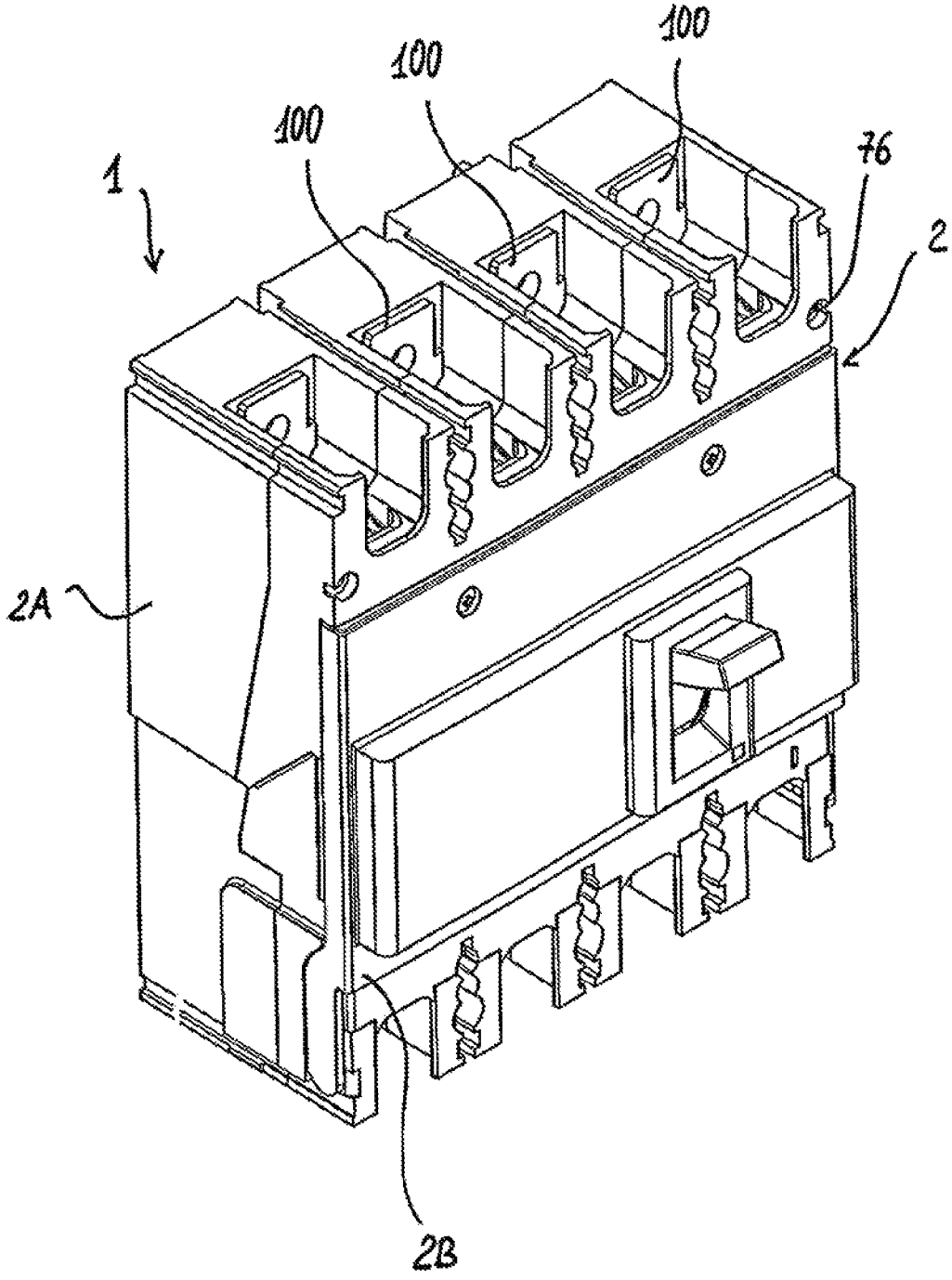
FIG. 1 is a perspective view of a first embodiment of a circuit-breaking device according to the present invention.

FIG. 1 is a perspective view of a first embodiment of a circuit-breaking device according to the present invention. More precisely, the circuit-breaking device 1 shown in the figure is an automatic circuit breaker, to which reference will be made hereinafter solely for descriptive purposes. This is on the understanding, however, that the technical solutions and the principles expounded below are also applicable to other types of circuit-breaking device. The circuit breaker 1 in FIG. 1 comprises an outer housing 2 consisting of a box 2A and a cover 2B, which are coupled together by removable connection means 76, such as screws. The box 2A is configured so as to contain a plurality of first electric terminals 100, each relating to one pole of the circuit breaker 1. Each electric terminal 100 is electrically connected to the fixed contact 10 on the corresponding pole. The cover 2B is also configured so as to contain second electric terminals (not shown in the figures), each of which corresponds to a pole of the circuit breaker 1 and is electrically connected to a moving contact 20.

Figure 2:
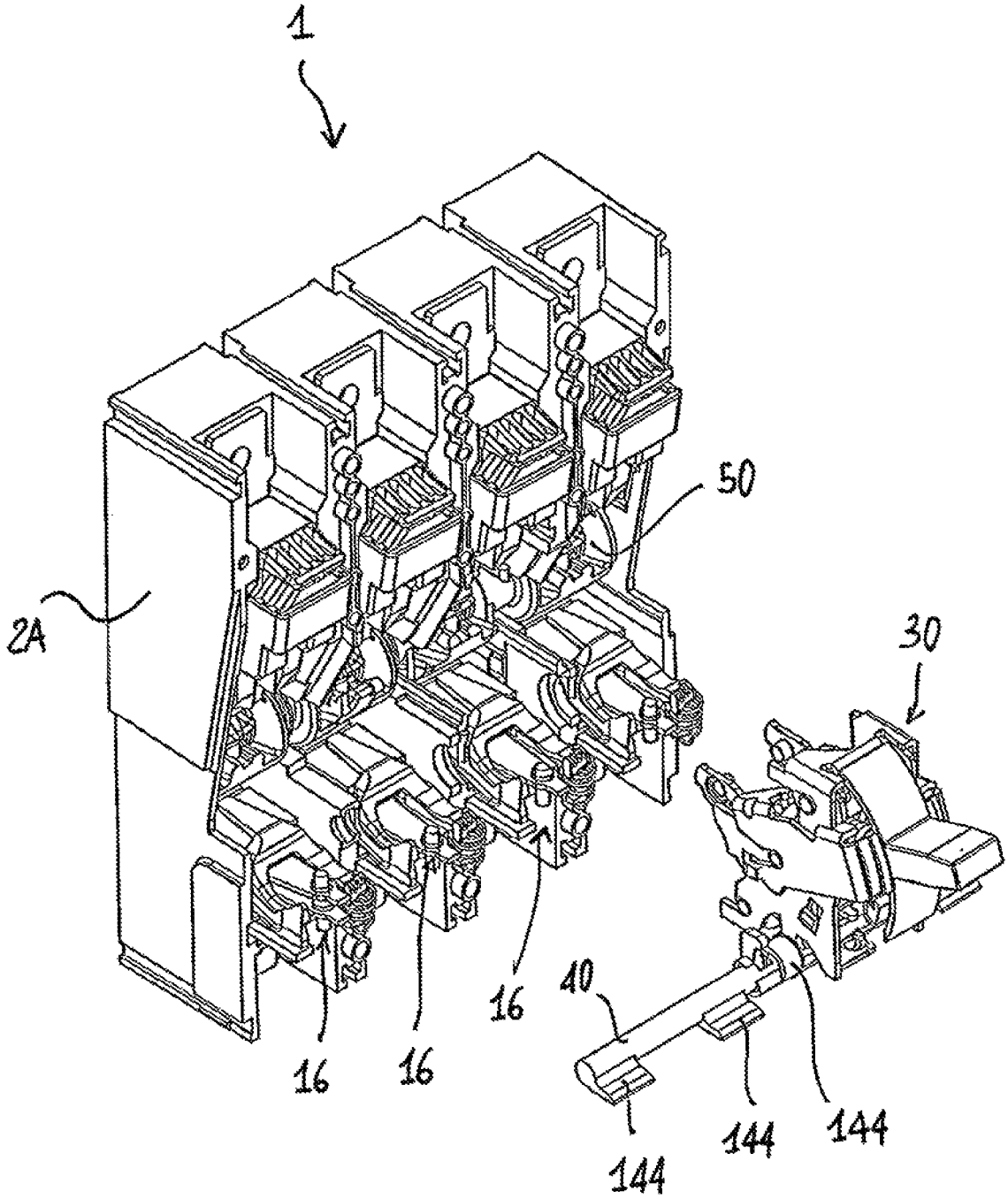
FIG. 2 is an exploded view of the circuit-breaking device in FIG. 1.

FIG. 2 is an exploded view relating to the circuit breaker in FIG. 1 with the cover 2B removed, showing the unit consisting of the trip shaft 40 and the control mechanism 30 separated from the rest of the circuit breaker 1. As shown, the box 2A preferably supports a moving part 50, which serves the purpose of containing the moving contacts 20 of the circuit breaker 1. More precisely, the moving part 50 comprises a shaped body that, for each pole in the circuit breaker 1, contains a seat for a moving contact 20.

Again with reference to FIG. 2, the box 2A contains a protection device that, for each pole, comprises a protection unit 16, which interacts with an operative portion 144 of the trip shaft 40. More precisely, said protection units 16 interact with the trip shaft 40 following the occurrence of a malfunction, such as a short circuit, on the line where the circuit breaker is installed. According to known embodiments, the protection units 16 may be of the thermal, magnetic, thermomagnetic or electronic type, or a combination thereof.

Figure 3:
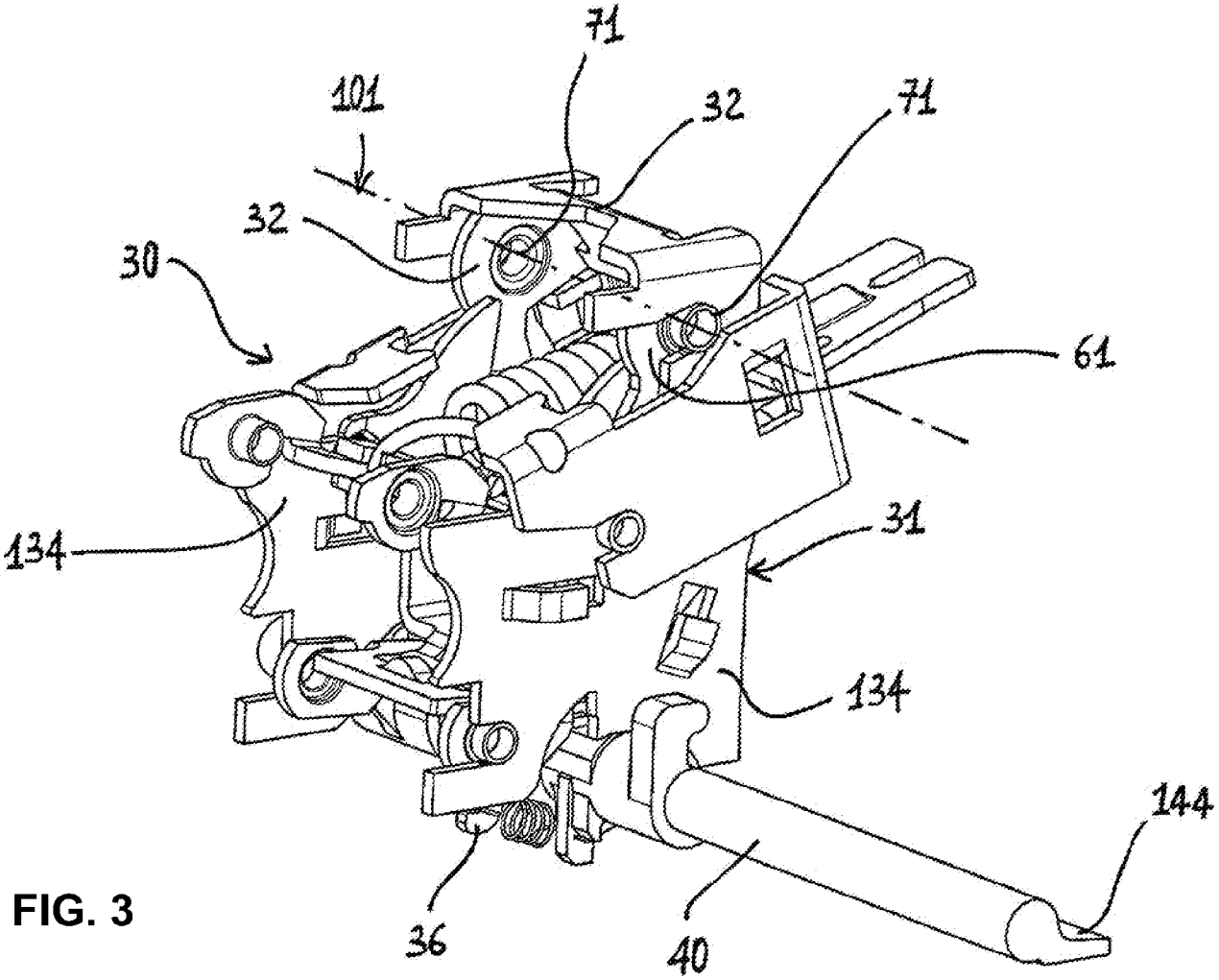
FIG. 3 is a perspective view of the control mechanism and of the trip shaft of the circuit-breaking device of FIG. 1.

FIG. 3 is a perspective view of the assembly consisting of the control mechanism 30 and the trip shaft 40. The control mechanism 30 is operatively connected to the moving contacts 20 by means of the moving part 50. More precisely, the control mechanism 30 can acquire a first operative configuration (hereinafter called the closed configuration) as a result of which each moving contact 20 is coupled with the corresponding fixed contact 10. The control mechanism 30 can also acquire a second configuration determined by a manual action brought to bear on one of the elements in the kinematic chain (the manual opening configuration) as a result of which each moving contact 20 is separated from the corresponding fixed contact 10. The control mechanism 30 can also acquire a third configuration determined by the enabling of the tripping device: this takes place as a result of an action of one of the protection units 16 on one of the operative portions 144 of the trip shaft 40. Said action induces the rotation of the trip shaft 40, which determines the displacement of a tripping element 36 (see FIG. 7) in the control mechanism 30. The movement of the tripping element 36 causes a "tripping" of the kinematic chain as a result of which the control mechanism 30 switches from the "closed" configuration to the "tripped" configuration.

Again with reference to FIG. 3, the kinematic chain of the control mechanism 30 comprises at least one operative element pivotally connected to the supporting frame 31 by means of the pin-shaped connection means. The operative element comprises a pair of facing lateral portions, which are connected by a transverse connecting portion. The pin-shaped connection means comprise a pair of pin-shaped ends, each of which emerges from one side of a lateral portion of the operative element, or of the supporting frame 31. The pin-shaped connection means also comprise a pair of seats, each of which is defined in the supporting frame in the operative element to contain a corresponding pin-shaped end. Once the pin-shaped ends have been inserted in the seats, an axis of mutual rotation is configured between the supporting frame 31 and said operative element connected thereto. The pin-shaped ends preferably have only one degree of freedom to rotate in relation to the corresponding seat during the operation of the control mechanism.

Figure 4:
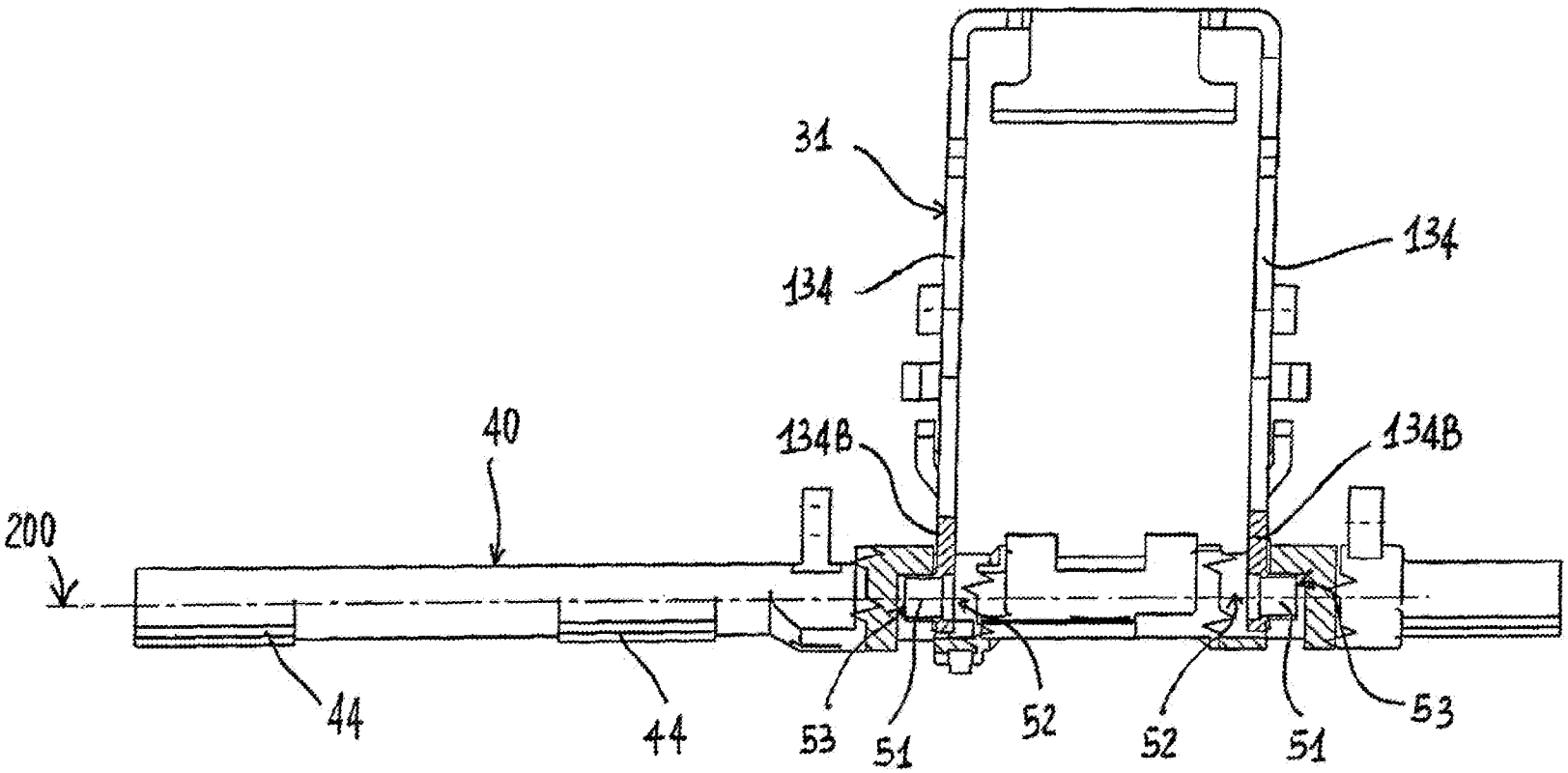
FIG. 4 is a cross-sectional view of the unit consisting of the supporting frame and the trip shaft of the device FIG. 1.

FIG. 4 is a cross-sectional view showing, for the sake of simplicity, the supporting frame 31 of the control mechanism 30 and the trip shaft 40. The sides 134 of the frame 31 each comprise an end portion 134B, from which a pin-shaped portion 51 emerges. Each end portion 134B is inserted in a corresponding shaped cavity 52, of which at least one recessed portion 53 has surfaces geometrically conjugated with those of the pin-shaped portion 51 of the supporting frame 31, so as to enable a relative displacement of the trip shaft 40 with respect to the sides 134 of the frame 31. More precisely, the recessed portion 53 is defined so as to be coaxial with the axis of rotation 200 of the trip shaft 40.

Figure 5:
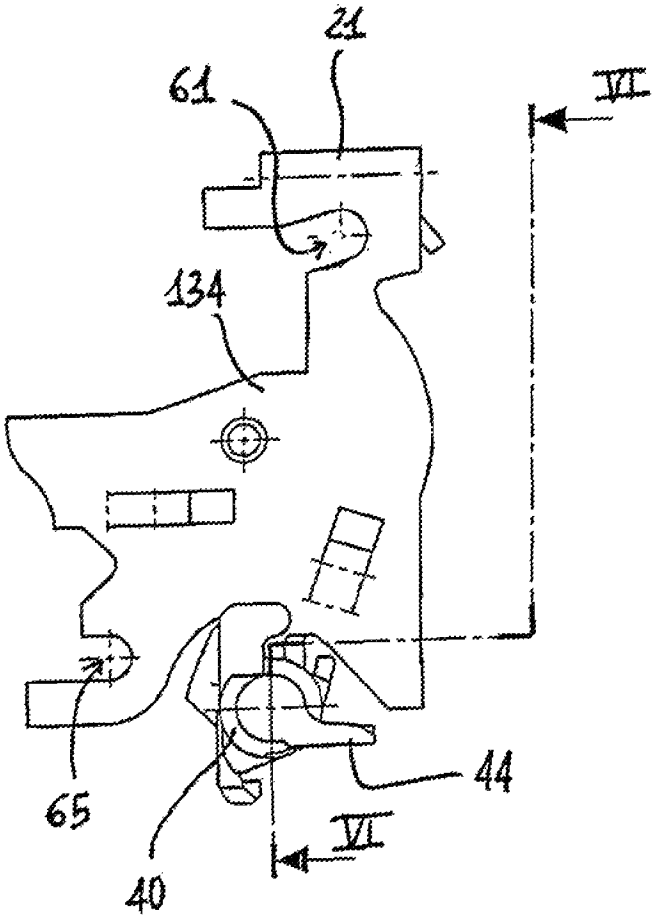
FIG. 5 is a side view of the unit consisting of the supporting frame and the trip shaft of the device in FIG. 1.

FIG. 5 is a side view of the set of components in FIG. 4, showing the conformation of the sides 134 of the supporting frame 31. In particular, said figure shows the seats 61,65 in which the pin-shaped ends 71,75 of the elements 32,36 (described in more detail below) of the control mechanism 30 are inserted, supported directly by the two sides 134. FIG. 5 also shows the operative position of the trip shaft 40 facing that of the transverse connecting portion 21. The longitudinal stretch of the trip shaft 40 coming in between the two shaped cavities clearly defines the above-described additional connecting portion between the sides 134 of the frame. As explained above, this solution advantageously enables an increase in the global stiffness of the frame 31 with obvious advantages in terms of the device's reliability.

Figure 6:
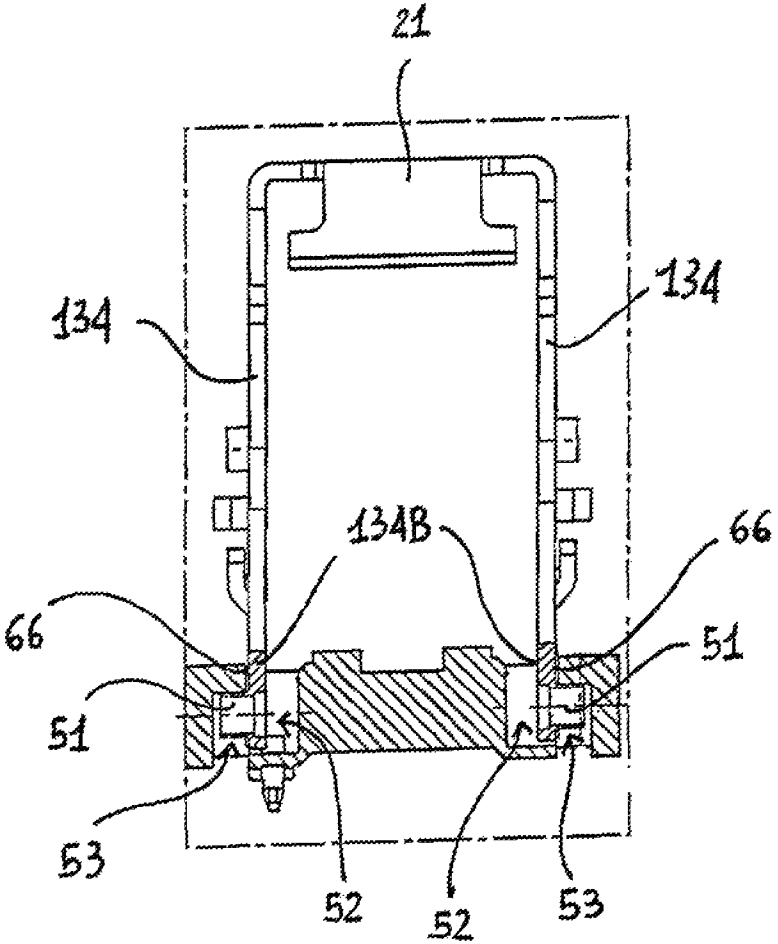
FIG. 6 is a cross-sectional view along VI-VI in FIG. 5.

FIG. 6 is a view along VI-VI in FIG. 5, which shows a cross-sectional view of the portion of the trip shaft 40 containing the cavities 52 in which the pin-shaped ends 51 of the sides 134 of the supporting frame 31 are inserted. Clearly, each cavity 52 defines an abutment surface 66 for one of the sides 134 of the frame 31, effectively preventing any axial movement of said sides.

The control mechanism 30 comprises a main hook 32 which is operatively connected to the supporting frame 31 by means of first pin-shaped connection means. The structure of the main hook 32 is shaped by a second pair of lateral portions 42 connected together by a second transverse connecting portion 22. The main hook 32 is connected to the supporting frame 31 by means of first pin-shaped connection means according to the invention, which define a first axis of mutual rotation 101. More precisely, the supporting frame 31 occupies a fixed position during the operation of the control mechanism 30. As a result, the main hook 32 rotates with respect to the supporting frame 31 around the above-defined first axis of mutual rotation 101.

Figure 7:
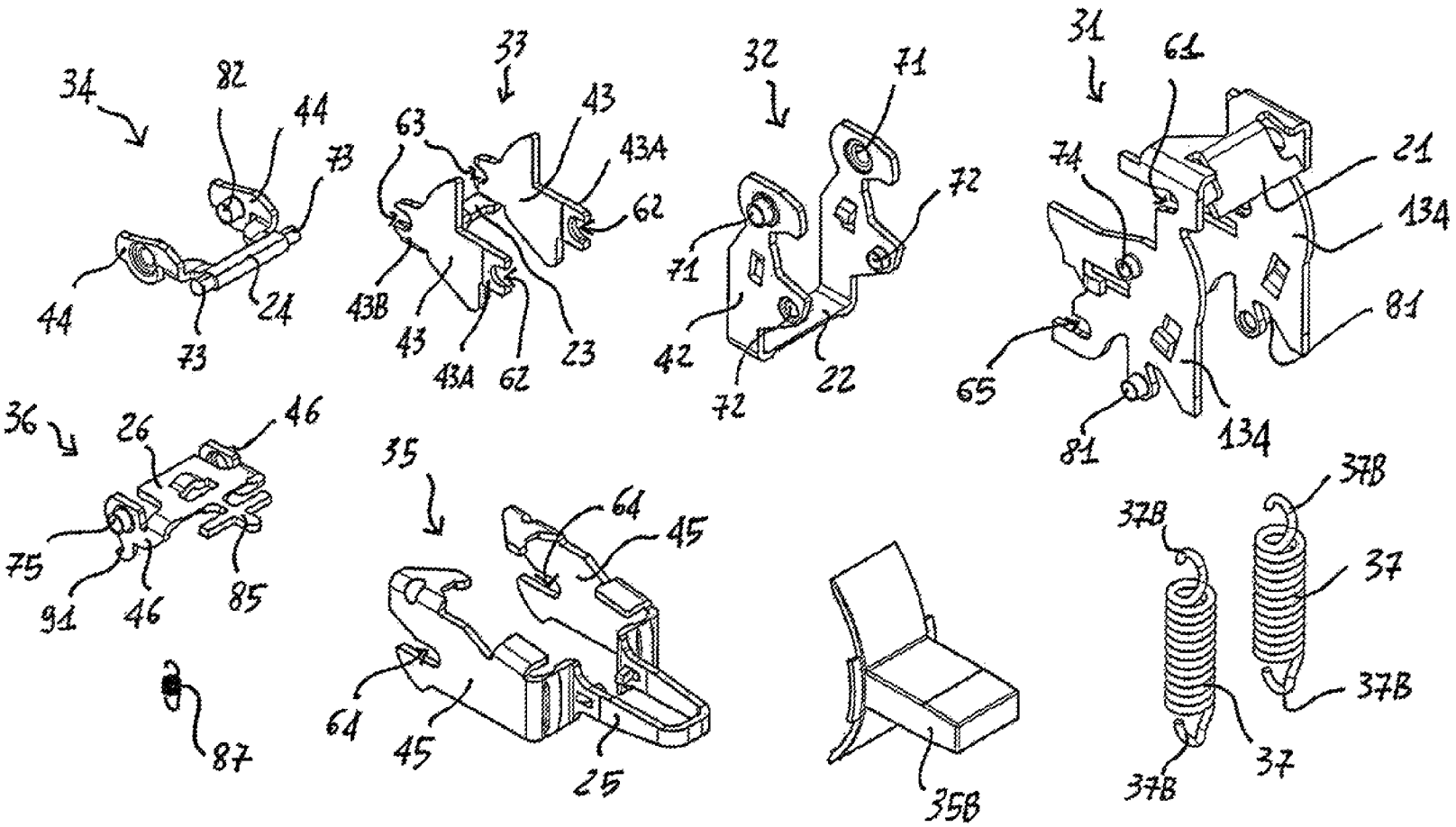
FIG. 7 is an exploded view showing the components of the control mechanism in the circuit-breaking device shown in FIGS. 1 to 6.

The first pin-shaped connection means comprise a first pair of pin-shaped ends 71 (hereinafter also indicated using the expression first pin-shaped ends 71), which emerge each from one of the lateral portions 42 of the main hook 32. More precisely, the first pin-shaped ends 71 are made in one piece with a corresponding lateral portion 42 emerging on an outer side of the external portion. The first pin-shaped connection means also comprise a first pair of seats 61 (hereinafter also indicated using the expression first seats 61), in each of which one of the first pin-shaped ends 71 of the main hook 32 is inserted. In particular, as shown in FIG. 7, the first seats 61 are configured substantially in a U shape so as to enable the insertion of the first pin-shaped ends 71 in a precisely defined direction.

The first seats 61 are defined in a position in the vicinity of the first transverse portion 21 of the supporting frame 31, while the first pin-shaped ends 71 are obtained in a position substantially remote from the second transverse portion 22 of the main hook 32. The first transverse portion 21 is thus located opposite the second transverse portion 22 of the main hook 32 once the two elements have been connected. Moreover, the lateral portions 42 of the main hook 32 come to occupy a position in between the lateral portions 42 of the supporting frame 31, so that the main hook 32 can rotate in relation to the frame 31, within said frame.

The control mechanism 30 shown in the figures comprises a third element 33, hereinafter indicated using the term "fork 33". The structure of the fork 33 comprises a third pair of facing lateral portions 43 that are connected together by means of a third connecting portion 23. The fork 33 is operatively connected to the main hook 32 by means of second pin-shaped connection means that configure a second axis of mutual rotation 102 (see FIGS. 8 and 9) substantially parallel to the first axis of rotation 101. The second pin-shaped connection means comprise a second pair of pin-shaped ends 72 (hereinafter indicated using the term second pin-shaped ends 72) and a second pair of seats 62 (hereinafter indicated using the expression second seats 62), each of which is suitable for containing one of the second pin-shaped ends 72. The latter are made in one piece with the main hook 32. The second pin-shaped ends 72 emerge, facing one another, from each of the internal sides of the lateral portions 42 of the main hook 32, while the second seats 62 are defined by the lateral portions 43 of the fork 33. More precisely, the second seats 62 have a substantially C-shaped configuration and are located in line with first facing terminal parts 43A of the lateral portions 43.

The fork 33 is connected to a fourth operative element 34 in the control mechanism 30, hereinafter indicated using the term "control rod" 34, which comprises a fourth pair of lateral portions 44 connected by a fourth transverse portion 24. The control rod 34 is operatively connected to the fork 33 by means of third pin-shaped connection means that configure a third axis of mutual rotation 103 (see FIGS. 8 and 9) substantially parallel to the above-described first and second axes 101,102. More precisely, the third pin-shaped connection means comprise a third pair of pin-shaped ends 73 (hereinafter indicated using the expression third pin-shaped ends 73) and a third pair of seats 63 (hereinafter indicated using the expression third pin-shaped seats 63), each of which is suitable for containing one of the third pin-shaped ends 73. The latter are made in one piece with the control rod 34 and they emerge on facing sides of the fourth transverse portion 24.

The third seats 63 are configured substantially in a C shape and are each defined on one of the lateral portions 43 of the fork 33. More precisely, the third seats 63 are defined in line with second facing terminal parts 43B of the lateral portions 43. Said second facing terminal parts 43B are substantially opposite the first terminal parts 43°, in line with which there are the second seats 62 for the second pin-shaped connection means.

The control rod 34 also comprises a second pair of connecting ends 82 made in one piece with the fourth lateral portions 44 so as to occupy mutually opposing positions. Each of these second connecting ends 82 emerges from the internal side of a lateral portion so that it can be inserted in corresponding centring seats (not shown) defined on the body of the moving part. More precisely, once said second connecting ends 82 have been inserted in the corresponding centring seats, they define an axis of mutual rotation for the control rod 34 in relation to the moving part 50 and vice versa. Said axis is in a position that is off-centre with respect to the axis of rotation of the moving part 50. As a result, a displacement of the control rod 34 determines a rotation of the moving part 50 and consequently of the moving contacts 20 contained therein.

The control mechanism 30 comprises a fifth operative element 35, hereinafter indicated using the term "lever-holder element" 35, which comprises a fifth pair of lateral portions 45 connected by a fifth transverse portion 25 that is at least partially folded over into a U shape. Said folding has the purpose of supporting a lever 35B, which extends from the housing 2 of the circuit breaker 1 once it has been assembled. In practice, the lever 35B serves as the interface between the circuit breaker 1 and an operator. As explained in more detail later on, the lever 35B occupies a particular position depending on the operative configuration of the control mechanism 30 (i.e. the closed, open or tripped configurations). As a result, an operator can ascertain the operative status of the circuit breaker 1 by observing the position of the lever 35B.

Figure 12:
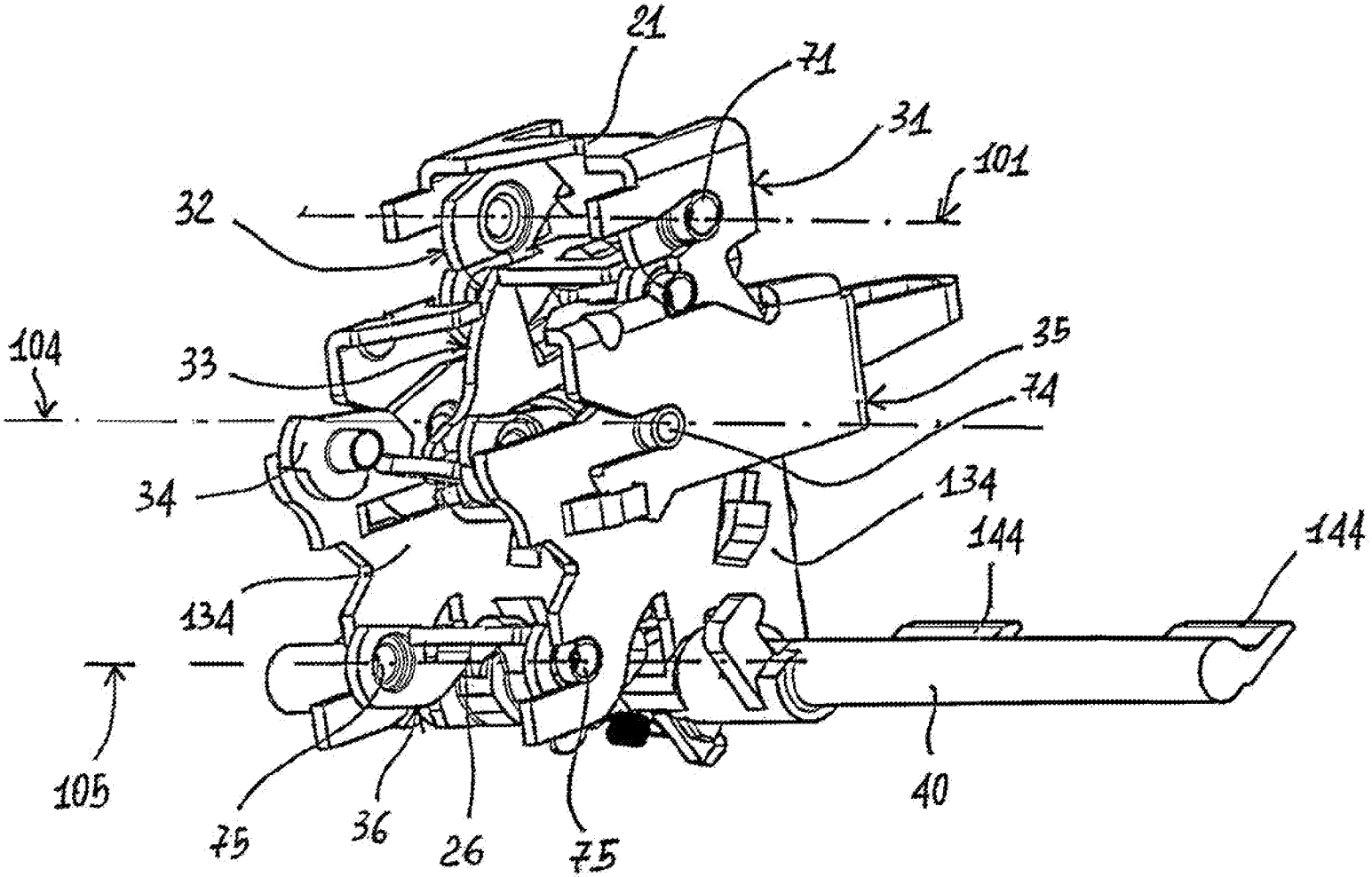
FIG. 12 is a perspective view of the control mechanism in FIG. 10.

The lever-holder element 35 is operatively connected to the supporting frame 31 by means of fourth connection means comprising a fourth pair of pin-shaped ends 74 (hereinafter indicated using the term fourth pin-shaped ends 74) that are obtained in one piece with the supporting frame 31. The fourth connection means also comprise a fourth pair of seats 64 (hereinafter also indicated using the expression fourth seats 64), each of which is defined on one of the fifth lateral portions 45 of the lever 35. Once the fourth ends 74 have been inserted in the corresponding fourth seats 64, they define a fourth fixed axis of rotation 104 (see FIG. 12) parallel to the axes of rotation described so far. Each of the fourth pin-shaped ends 74 emerges from a corresponding external side of a side 134 of the supporting frame 31 and slots into a corresponding fourth seat 64 configured substantially in a C shape.

As already mentioned above, the control mechanism 30 comprises a tripping element 36 operatively connected to the supporting frame 31 by means of fifth pin-shaped connection means. More precisely, the tripping element 36 structurally consists of a sixth pair of facing lateral connecting portions 46, which are connected by a fifth transverse portion 26. The latter comprises a first hooked end 85 that serves the purpose of intercepting a second hooked end (not shown) of the main hook 32.

The fifth pin-shaped connection means comprise a fifth pair of pin-shaped ends 75 made in one piece with the sixth lateral portions 46 of the tripping element 36. More precisely, each of these fifth pin-shaped ends 75 emerges from an external side of one of the lateral portions 46. The fifth connection means also comprise a facing fifth pair of seats 65, each on one side 134 of the supporting frame 31. Each of the fifth pin-shaped ends 75 is inserted in a corresponding fifth seat 65 so as to configure a fifth fixed axis of rotation 105 (see FIG. 12) for the rotation of the tripping element 36.

Figure 11:
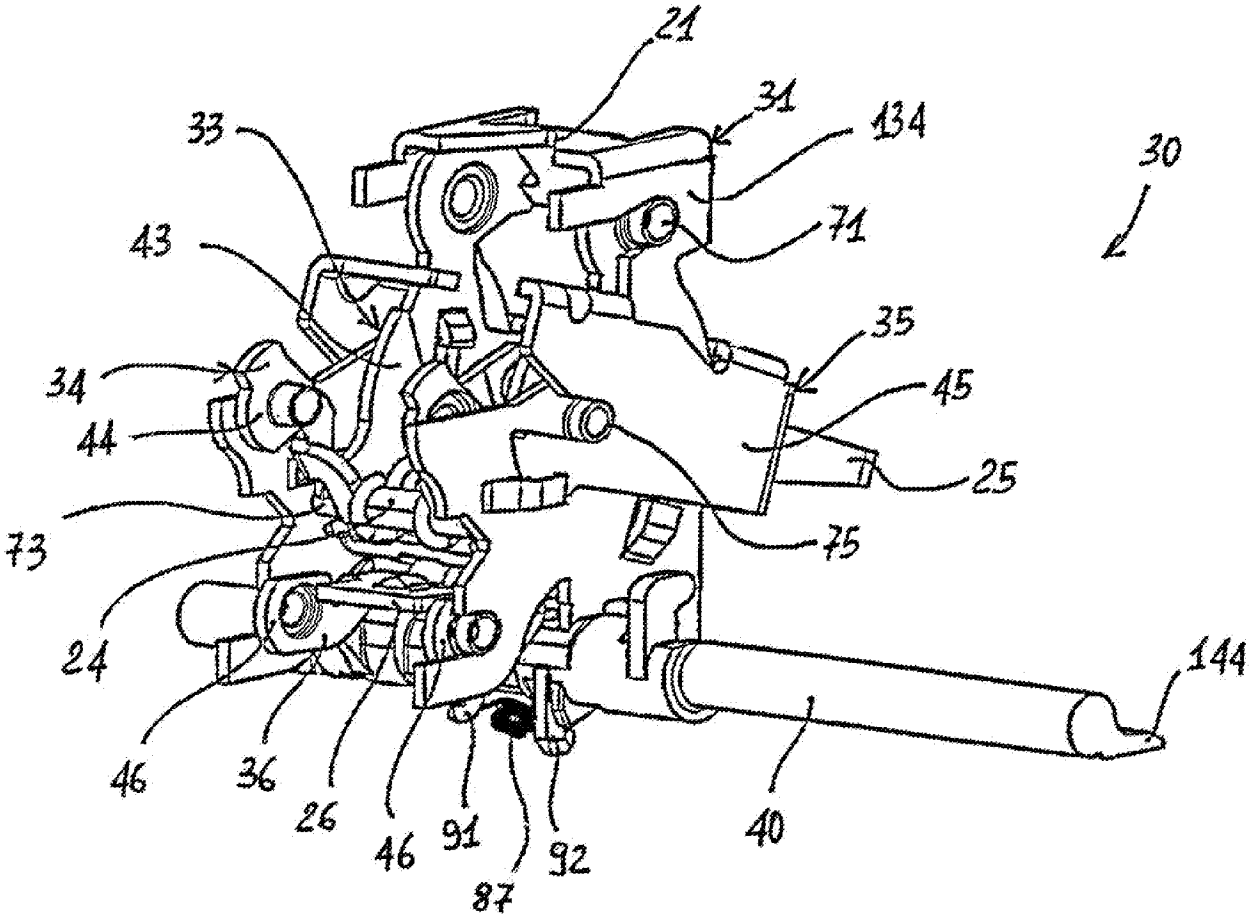
FIG. 11 is a perspective view of the control mechanism in FIG. 9.

With reference to the perspective view in FIG. 11, at least one of the lateral portions 46 of the tripping element 36 comprises a first activating end 91 that is operatively connected to a second activating end 92 emerging from the trip shaft 40. Any rotation of the trip shaft 40, following the tripping of a protection device, is thus translated into a displacement of the first end 92 that withdraws the support for the element 85, inducing a rotation of the tripping element 36 around the fifth axis of rotation 105. The tripping element 36 can consequently pass from the hooked position to the released position, at which point the main hook 32 becomes free to rotate around the first axis of rotation 101. The two activating ends 91,92 are mutually connected by a return spring 87 that enables the device to be suitably reset from the tripped position to the open position.

The control mechanism 30 comprises at least one control spring 37, and preferably two. Each control spring 37 is operatively connected at one end to the fourth transverse portion 24 of the control rod 34, and at the other end to the fifth transverse portion 25 of the lever-holder element 35, by means of suitable hooks 37B. Inside the control mechanism 30, each control spring 37 serves more than one purpose. Its first purpose is to provide the mechanism with the elastic force needed to accelerate the rotation of the moving part 50, i.e. the opening or closing of the contact, by means of the control rod 34. Each control spring 37 also serves the purpose of exerting an elastic force on the pin-shaped ends 71,72,73,74,75 of the coupled elements so that they maintain a stable position inside the corresponding seat 61,62,63,64,65 in which they are inserted. In other words, each control spring 37 takes effect on the various elements of the control mechanism 30 so as to keep each element constantly connected to the others. In practice, each control spring 37 exerts a force on the various pin-shaped ends 71,72,73,74,75 that is oriented in a direction concordant with the direction in which they are inserted in the corresponding seats 61,62,63,64,65. Moreover, each control spring 37 exerts said force on the various pin-shaped ends 71,72,73,74,75 whatever the configuration of the control mechanism 30 so that the functionality of the device is always guaranteed. A further function of the springs 37 consists in ensuring a suitable pressure on the electric contacts when the circuit breaker is in the closed configuration.

This embodiment is particularly advantageous in that it exploits the action of the kinematic thrust elements (i.e. the control springs 37) to keep the control mechanism 30 stably assembled. This makes it possible to broaden the range of the dimensional tolerance for the pin-shaped ends and the related seats, with obvious advantages in terms of the overall manufacturing costs.

Figure 8:
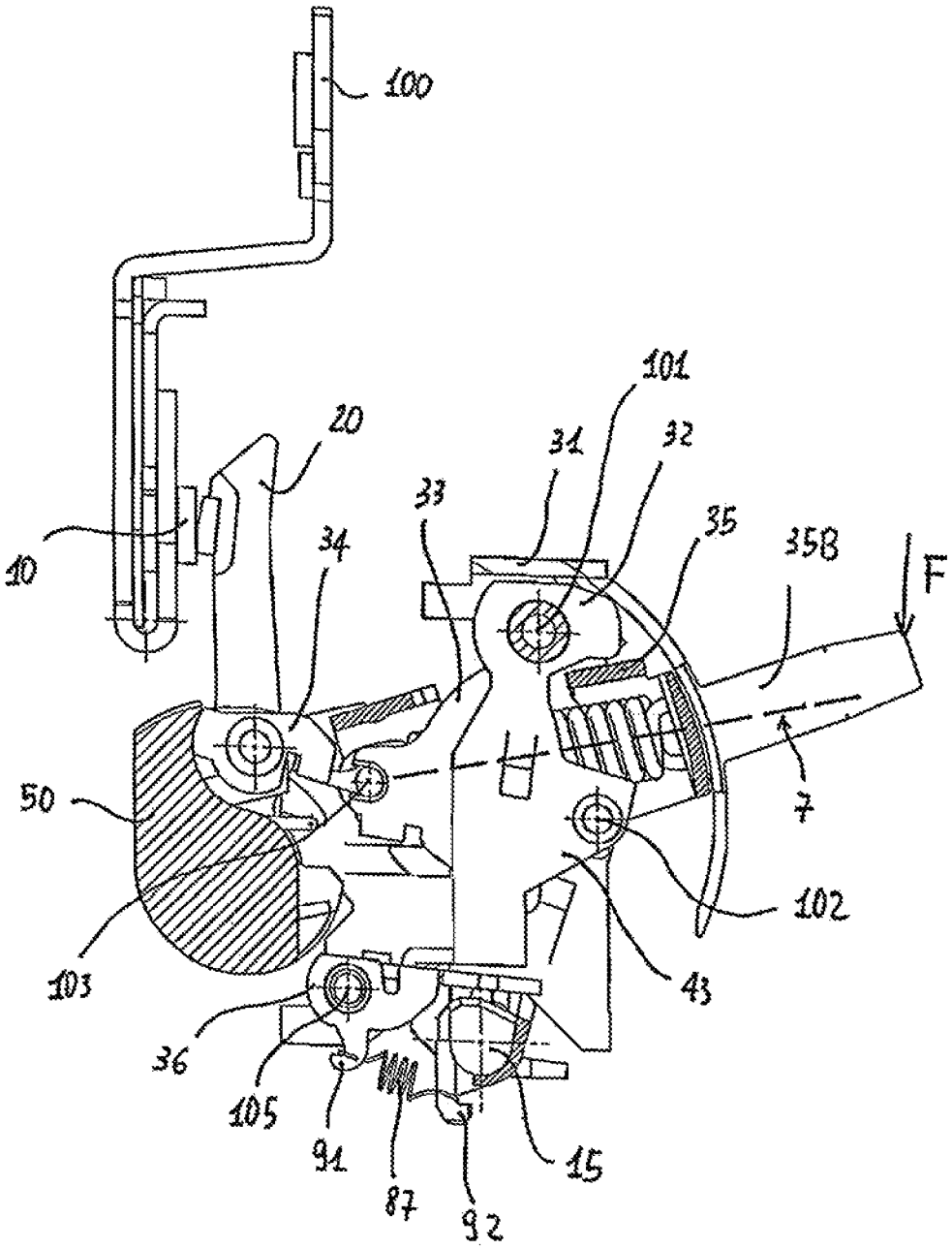
FIG. 8 is a view of the control mechanism in FIG. 1 in its closed configuration.
Figure 9:
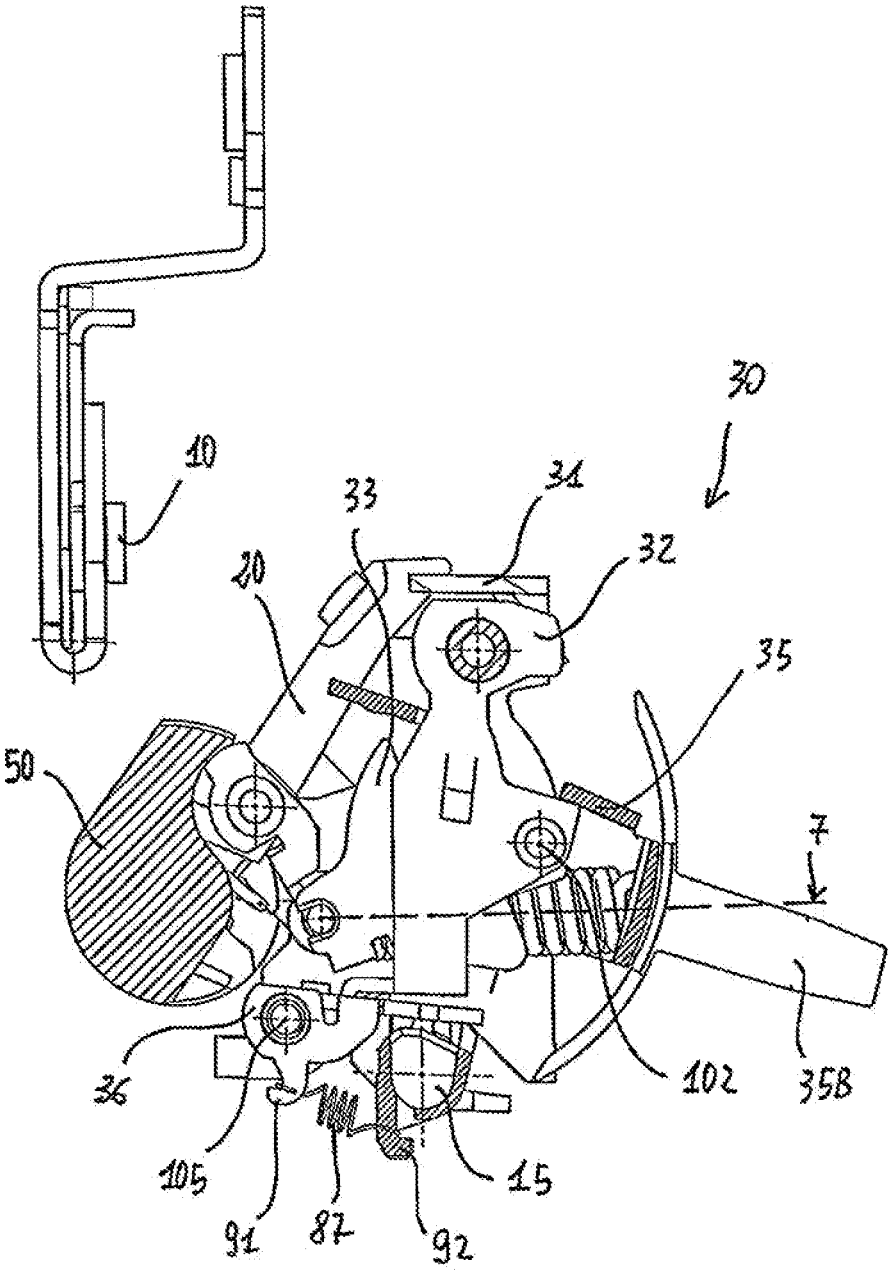
FIG. 9 is a view of the control mechanism in FIG. 1 in its open configuration.

FIG. 8 is a cross-sectional view of the control mechanism 30 shown in a closed configuration, wherein the moving contacts 20 are coupled with the corresponding fixed contacts 10. In this configuration, the control springs 37 are under a tensile stress and exert an elastic force that develops along a line 7. In practice, said line 7 is defined by the points where the control springs 37 engage respectively with the control rod 34 and the lever-holder element 35. The tripping element 36 of the control mechanism thus comes to be in the hooked position, withholding the main hook 32, i.e. prevent it from rotating around the first axis 101.

The passage from the closed configuration of FIG. 8 to the open configuration (shown in FIG. 9) is achieved as a result of a manual action (indicated by the arrow F in FIG. 8) exerted by an operator on the lever 36. This manual action F induces the rotation of the lever-holder element 35 around the fourth axis of mutual rotation 104 (see FIG. 12). During a first phase of rotation of the lever-holder element 35, the moving contacts 20 remain coupled, while the control springs 37 connected between the lever-holder element 35 and the control rod 34 come under a progressively increasing tensile stress. This condition persists up until the line 7 intersects the second axis of mutual rotation 102 defined by the second pin-shaped connection means that connect the main hook 32 to the fork 33. When this happens, the control springs 37 reach their maximum extension, i.e. their maximum allowable tensile stress. As soon as the line 7 drops beyond the second axis of rotation 102, the control springs 37 release the elastic energy accumulated during the first opening phase. This determines a rapid entrainment of the control rod 34 downwards, i.e. in the direction of the hook 36, which induces the rotation of the moving part 50 around its axis of rotation, and this is translated into a rapid separation of the contacts 10,20. At the end of the opening phase, the control mechanism 30 reaches the configuration shown in FIG. 9. Clearly, the tripping element 36 remains in its hooked position during a manual opening manoeuvre.

Figure 10:
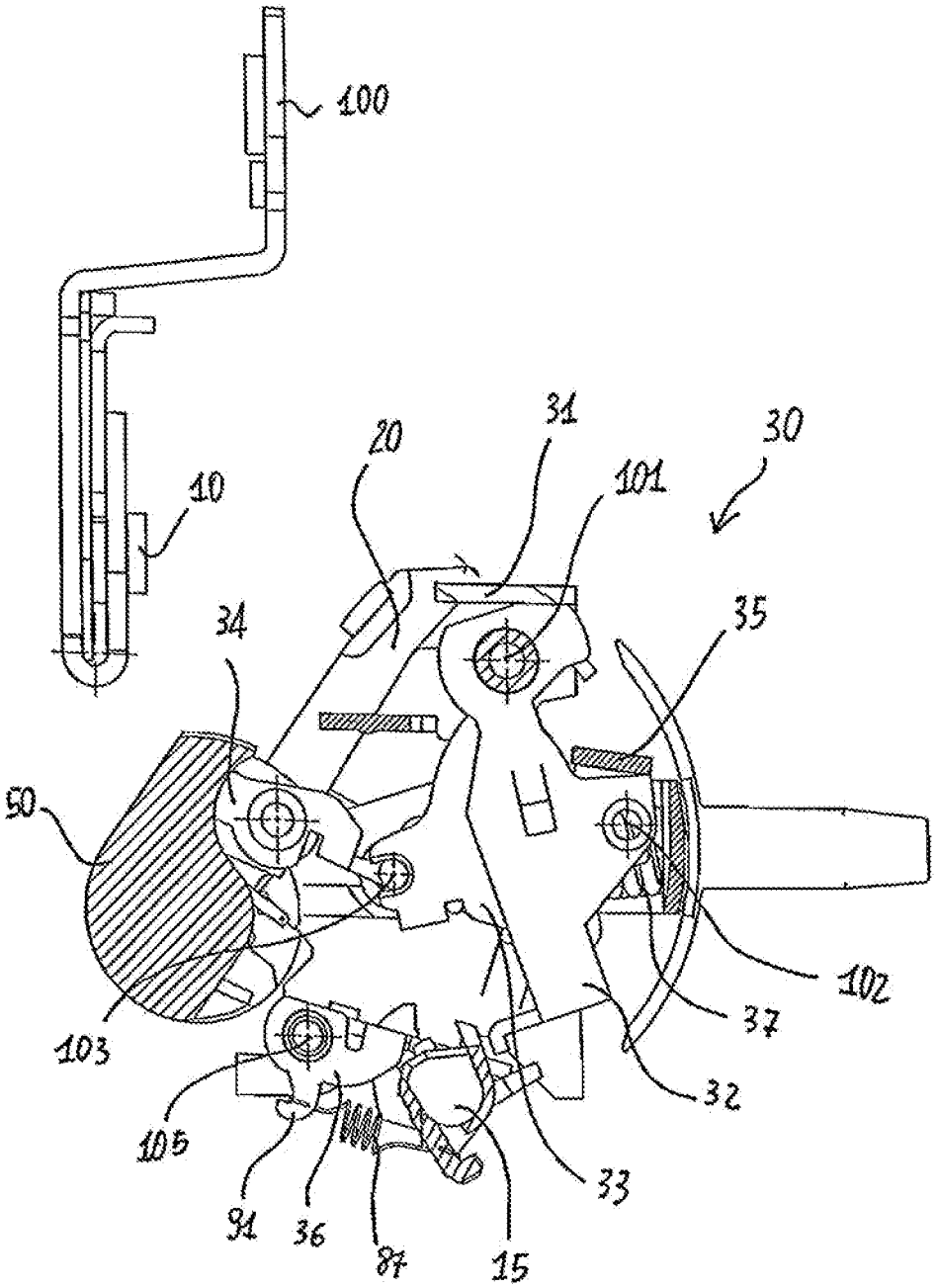
FIG. 10 is a view of the control mechanism in FIG. 1 in its tripped configuration.

FIG. 10 shows the control mechanism 30 in its "tripped" configuration. The passage from the closed configuration (in FIG. 7) to this tripped configuration takes place due to an action of a protection device in the circuit breaker 1, which causes a rotation of the trip shaft 40. Said rotation is translated into a rotation of the tripping element 36 around the fifth axis of rotation 105 that brings it into a released position, as a result of which the main hook 32 is free to rotate in relation to the supporting frame 31 around the first axis of mutual rotation 101. More precisely, when the main hook 32 is released, the control springs 37 exert a tensile stress on the control rod 34 in the direction of the lever 35B. Said tensile stress comes to bear on the main hook 32 through the fork 33, causing the rotation of said hook 32 around the first axis of rotation 101. The entrainment of the control rod 34 in turn prompts the rotation of the moving part 50 and the consequent sudden separation of the contacts 10,20. The control mechanism 30 thus acquires the configuration shown in FIG. 9, which is clearly different from the one in FIG. 9, which shows a manual opening configuration.

According to a preferred embodiment, the supporting frame 31 shown in the figures from 1 to 12 is made of a metallic material, such as sheet metal. More precisely, the sides 134 of the frame 31 are made in a single piece with the transverse connecting portion 21.

Figures from FIGS. 13 to 29 refer to a second embodiment of a circuit-breaking device according to the invention. In particular, the figures again relate to an automatic circuit breaker 3 preferably for use for lower currents than in the case of the circuit breaker 1 shown in figures from FIGS. 1 to 6.

Figure 14:
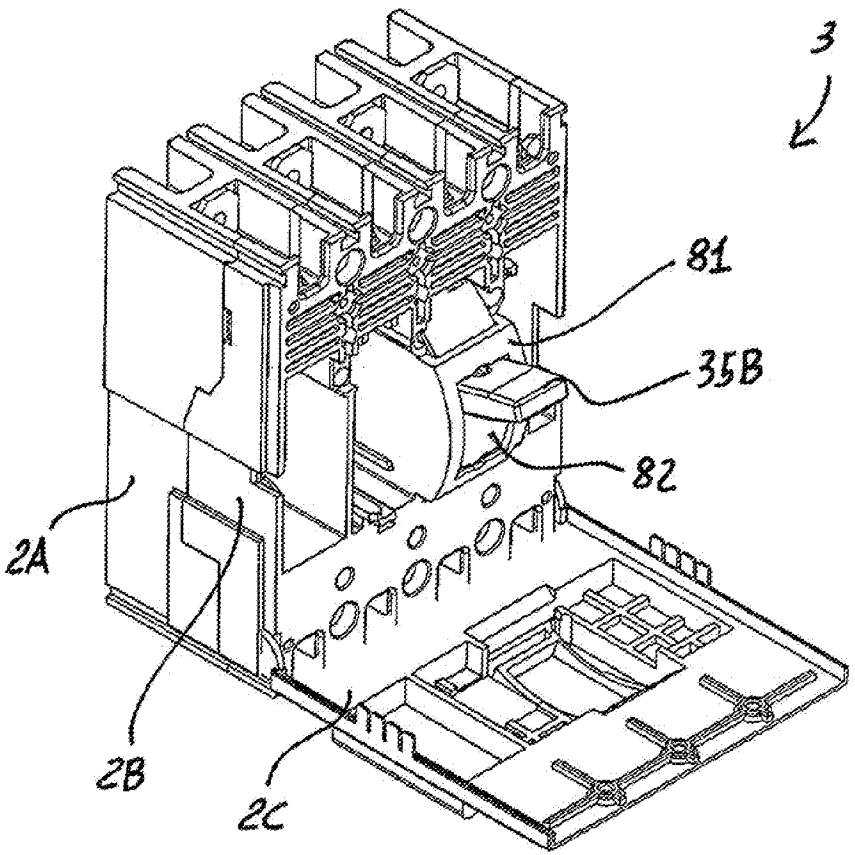
FIG. 14 is a second perspective view of the device in FIG. 13.
Figure 13:
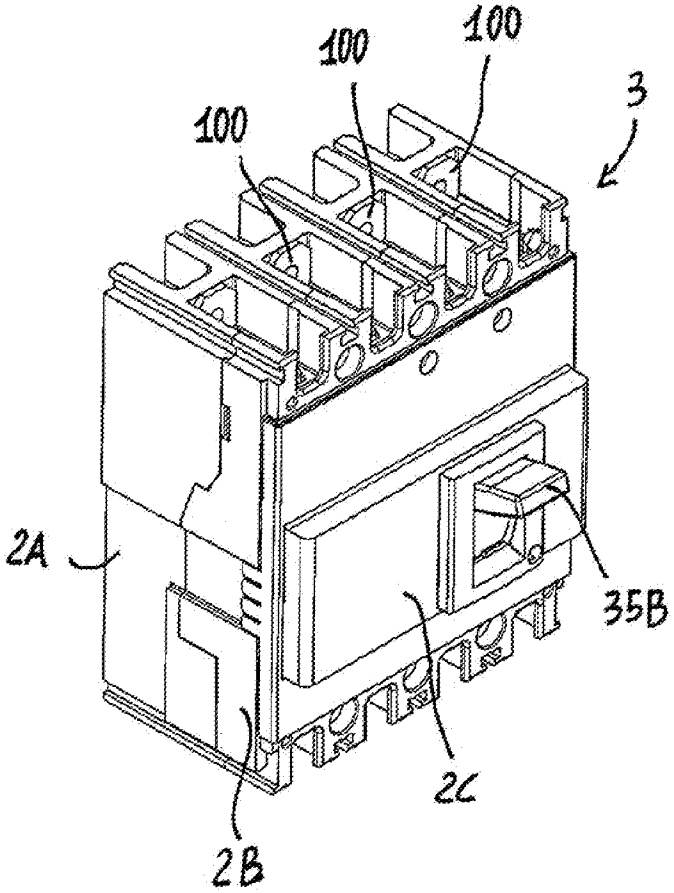
FIG. 13 is a first perspective view of a second embodiment of a circuit-breaking device according to the present invention.

With reference to FIGS. 13 and 14, the structure of the housing for the circuit breaker 3 is substantially similar to that of the previously-described circuit breaker 1, being complete with a box 2A and an associated cover 2B and a protective front plate 2C. FIG. 13 shows the automatic circuit breaker 3 ready for installation, i.e. after completing its assembly, while FIG. 14 shows the same circuit breaker 3 with the protective front plate 2C detached from the cover 2B.

Figure 15:
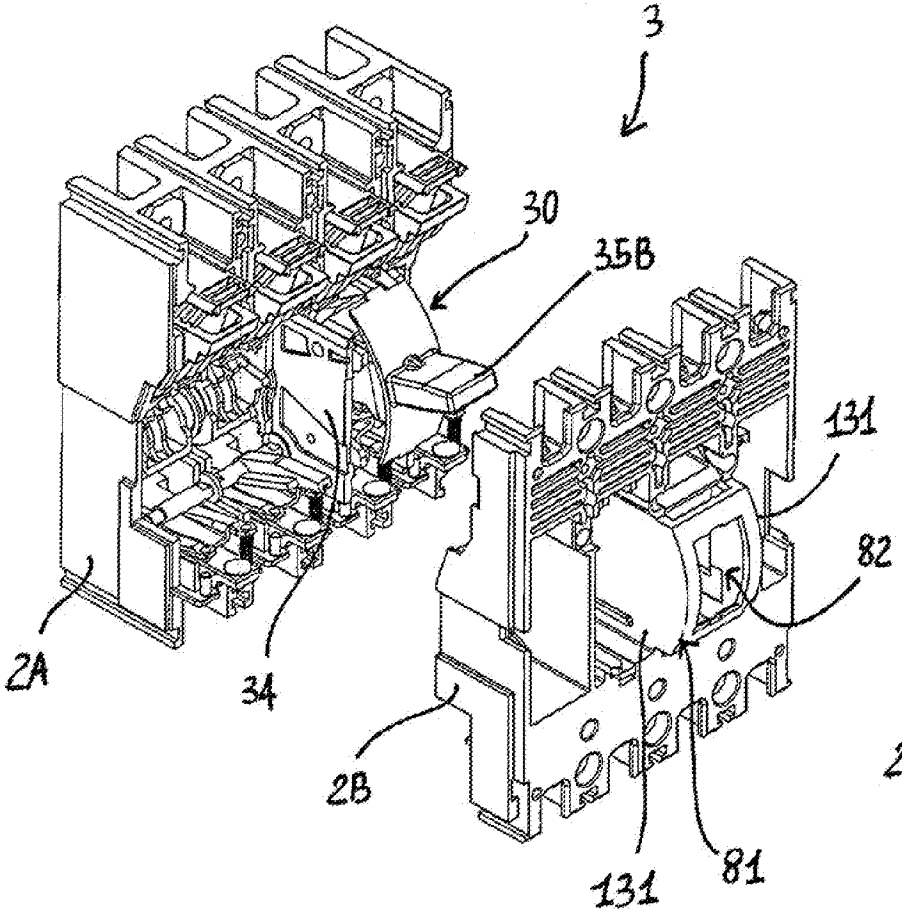
Figure 17:
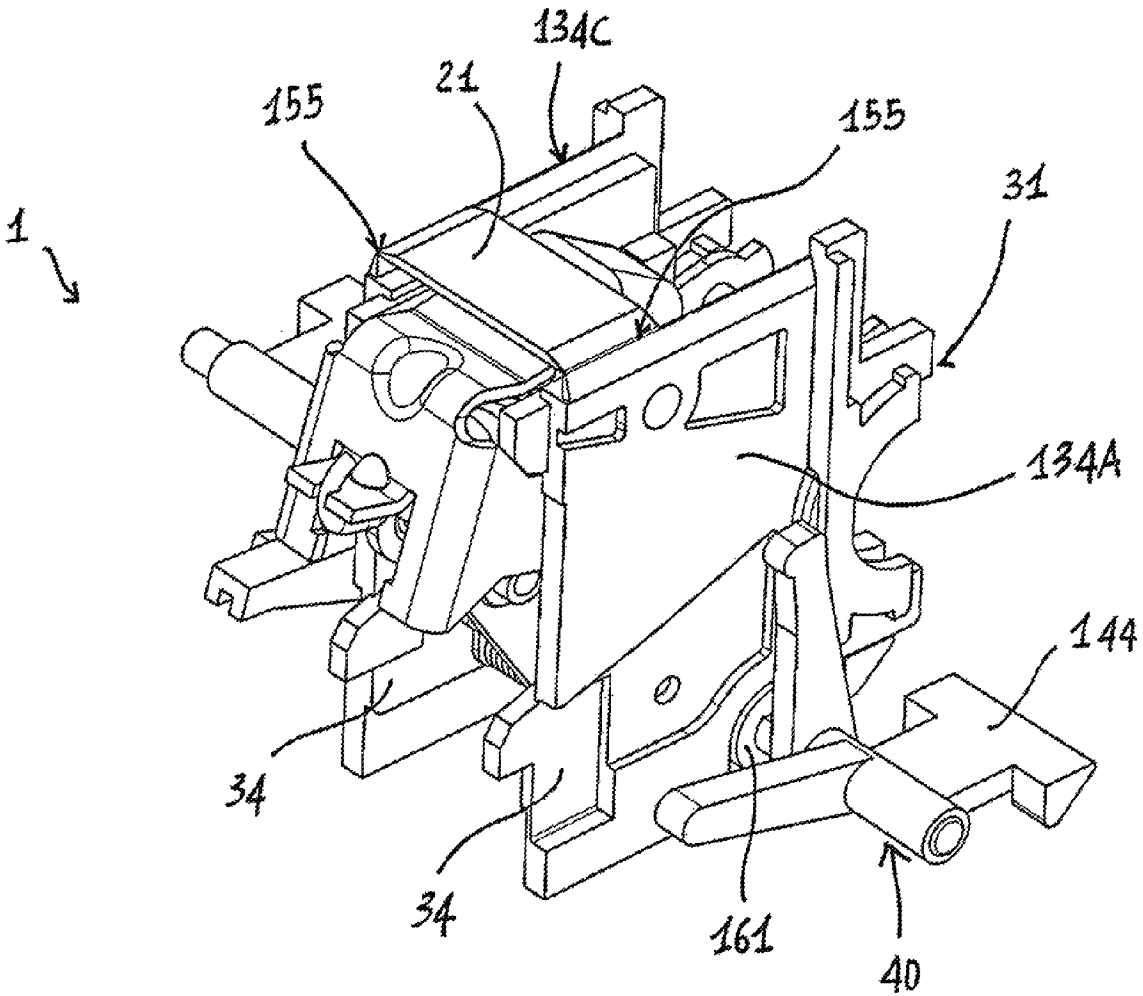
FIG. 17 is a perspective view of the control mechanism in the circuit-breaking device illustrated in FIGS. 13 to 16.

FIG. 15 is a first exploded view of the circuit breaker 3 in FIG. 13, showing the breaker without the protective front plate 2 C. More precisely, FIG. 15 shows the details of the cover 2B of the circuit breaker 3, in which a supporting structure 81 is defined that serves the purpose of supporting the control mechanism 30. The structure comprises a pair of supporting walls 131 that are usually facing and geometrically conjugated to the sides 134 of the supporting frame 31 of the control mechanism 30 in order to keep the latter correctly positioned during the normal operation of the circuit breaker. Again with reference to FIG. 15, between the lateral supporting walls 31 there is an opening 82 through which the control lever 35B of the control mechanism 30 emerges once the automatic circuit breaker 3 has been assembled.

Figure 16:
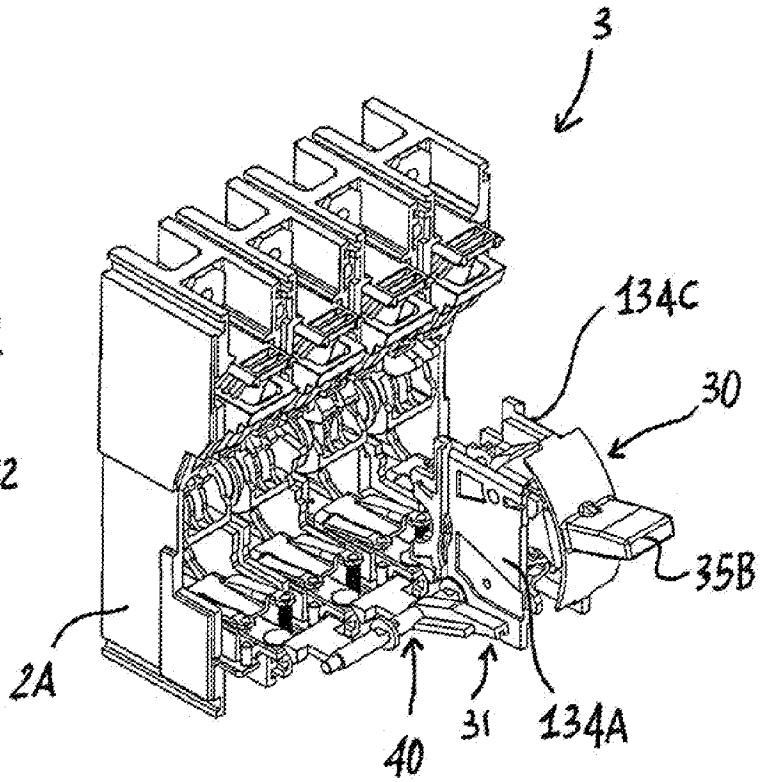
FIGS. 15 and 16 are respectively a first view and a second exploded view of the device in FIG. 13.

FIG. 16 is a second exploded view of the circuit breaker 3 showing the unit comprising the control mechanism 30 and the trip shaft 40 separated from the rest of the circuit breaker 3. As shown in this second embodiment, the shapes of the trip shaft 40 and of the control mechanism 30 differ from those of the same elements in figures from FIGS. 1 to 12. As explained in more detail later on, the supporting frame 31 and the trip shaft 40 are connected differently, i.e. by means of a substantially "keyed" type of connection. This connection basically involves the insertion of a pair of shaped portions 121 of the trip shaft 40 inside suitable connecting seats 122 each defined on an end portion of one side 134A,134C of the frame 31.

As shown in FIGS. 19 and 21, each of said seats 122 comprises a tapered portion 123 that extends from the edge 140 of the corresponding side 134 of the frame 31. More precisely, the portion 123 is tapered towards the internal side of the side 134. The seat 122 also comprises a circular portion 141 that extends from the innermost section of the tapered portion 123. Said circular portion 141 has a diameter D1 that is greater than the dimension S of the innermost cross-section of the tapered part 123.

FIGS. 20 and 21 show the conformation of the shaped portions 121 designed to be contained in the connecting seat 122. Each shaped portion 121 comprises a stretch of axial cross-section, identified as L1, on which two plane surfaces 125 are defined in a position facing the axis of rotation of the shaft 40. As shown in FIG. 20, the distance H between the two plane surfaces is narrower than the diameter of the cylindrical stretch L1. Said diameter is chosen so that it preferably coincides with the diameter D1 of the circular portion 141 of the connecting seat 122, while the distance H1 between the plane surfaces 125 is narrower than the dimension S relating to the innermost cross-section of the tapered portion 123.

The shaped portions 121 are inserted in the corresponding connecting seats 122 keeping the shaft 40 oriented so that the shaped portions each face towards a surface 145 of the tapered portion 123. Once the shaped portions 121 have reached the circular portion 141, the shaft is rotated approximately 90° around its axis of rotation 200. In this condition, the shaped portions 121 remained engaged to the inside of the circular portion 141 and the trip shaft 40 remains free to rotate, supported in said rotation by the surfaces of said circular portions 141.

With reference again to FIG. 20, the trip shaft 40 comprises an abutment ring 161 that emerges in a position adjacent to a corresponding shaped portion 121. The abutment ring 161 defines an abutment surface 166 for a portion of the side 134° of the frame 31 that surrounds the corresponding connecting seat 122. This embodiment advantageously increases the stiffness of the structure of the supporting frame 31 because it hinders any lateral sagging of the sides 134A,134C. The above-described technical solutions may also be replaced by other, functionally equivalent solutions that shall consequently be considered as a part of the present invention.

Figure 22:
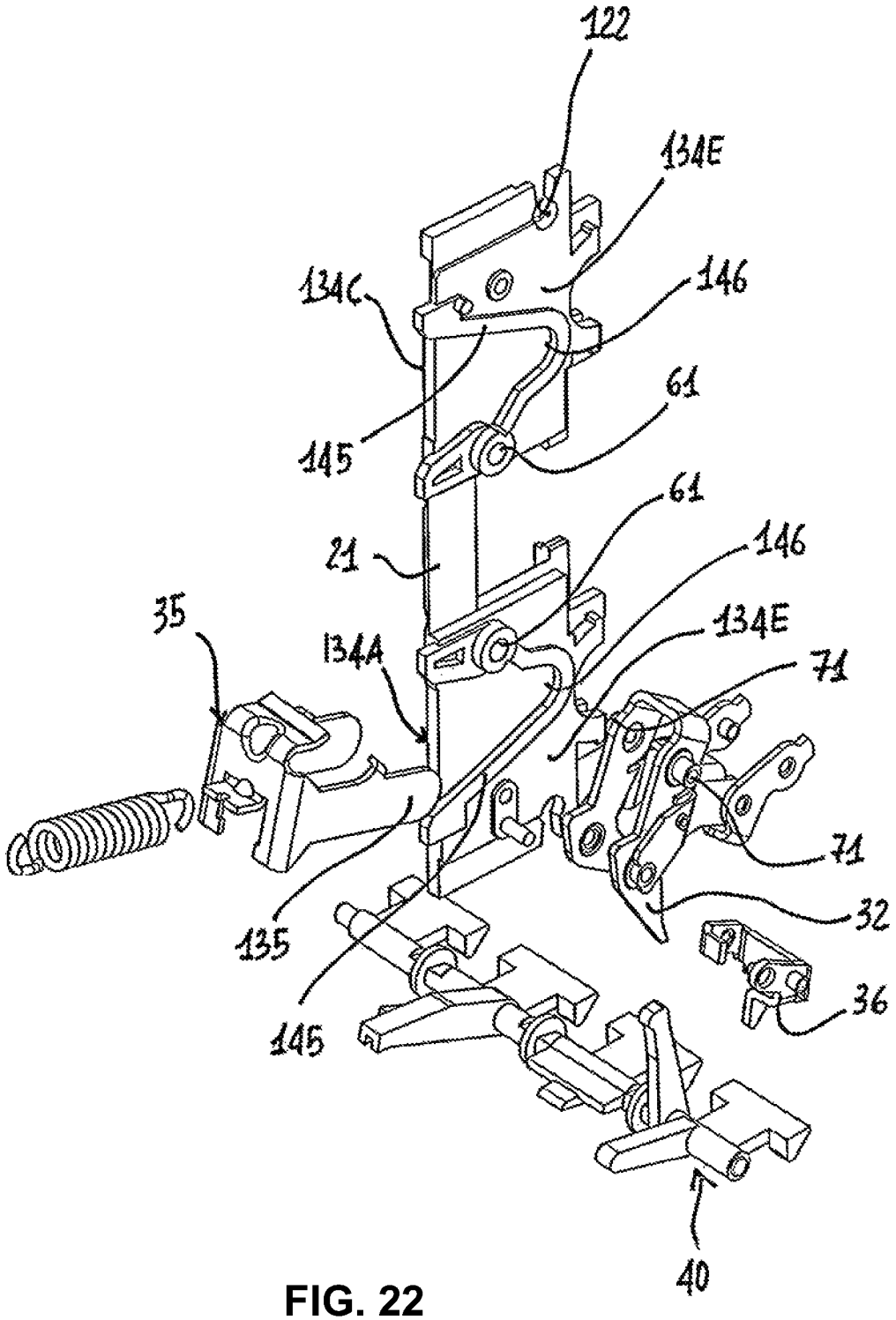
FIG. 22 is an exploded view of the control mechanism in the device illustrated in figures from FIGS. 13 to 16.

FIG. 22 is an exploded view showing the control mechanism illustrated in figures from 13 to 16. The kinematic chain comprising the mechanism is conceptually equivalent to the one described in detail for the embodiment illustrated in figures from FIGS. 1 to 12. It should be noted, in particular, that the elements comprising the kinematic chain are mutually connected by pin-shaped connection means in much the same way as explained previously. As in the previous solution, a main hook 32, with a tripping element 36, is hinged to the supporting frame 31. The sides of the hook 32 and of the tripping element 36 comprise pin-shaped ends 71,75 for inserting in corresponding seats 61,65, each of which is defined on the internal side 134E of one of the sides 134A, 134C of the frame 13.

Figure 23:
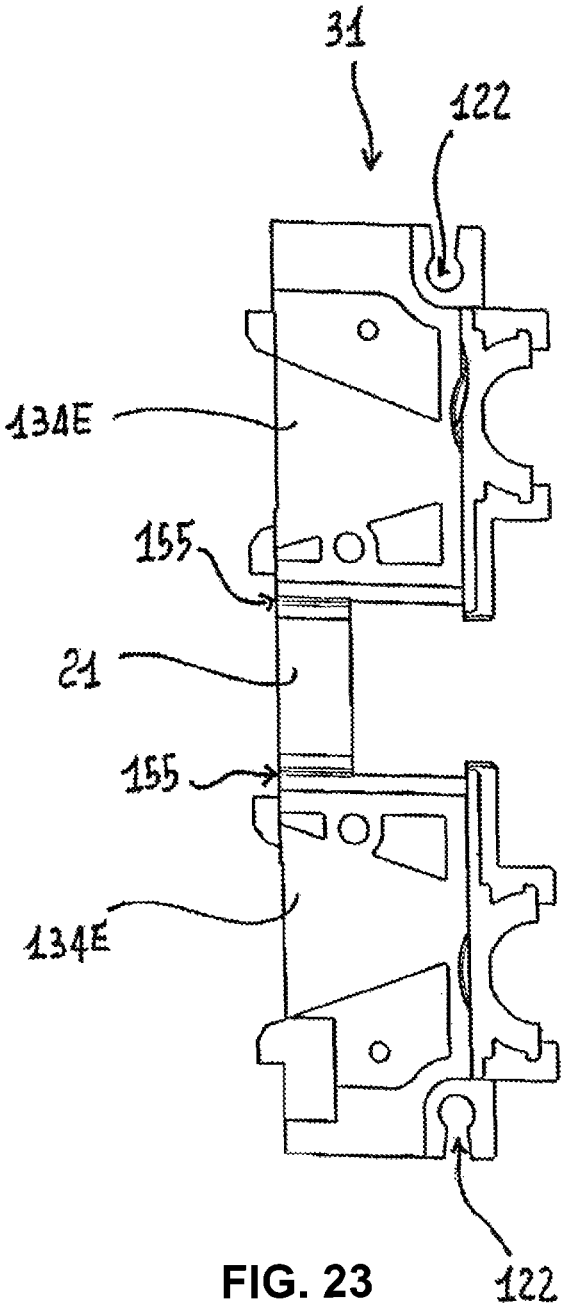
FIGS. 23 and 24 are views relating to the supporting frame of the control mechanism of the device illustrated in figures from FIGS. 13 to 16.
Figure 24:
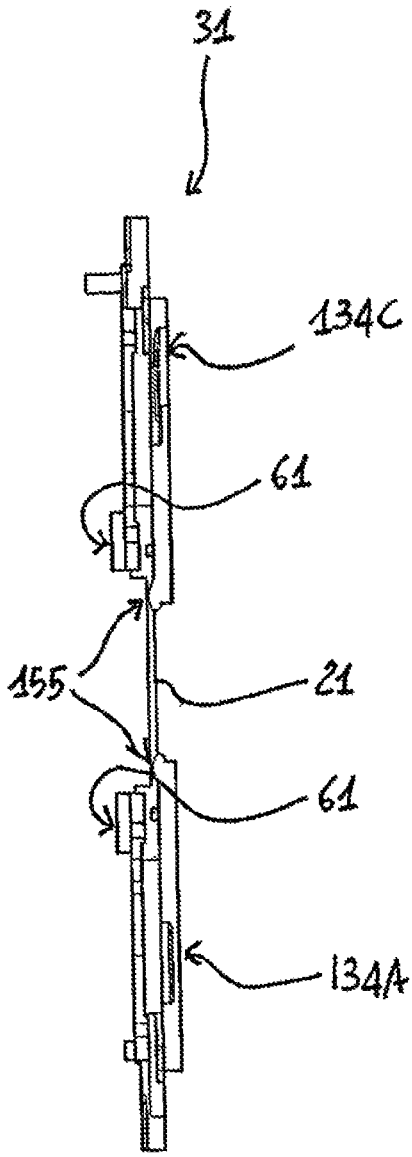
Figure 25:
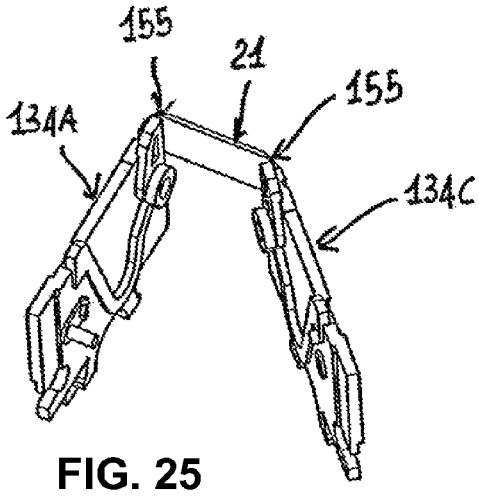

FIGS. 23 and 24 are two projections of the supporting frame 31, which is manufactured preferably by moulding a plastic material. More precisely, the sides 134A, 134C of the frame 31 are moulded in one piece with the transverse connecting portion 21. This solution proves extremely advantageous in that it enables the supporting frame 31 to be shaped in a single technological step i.e. in only one process. In fact, such a moulding also enables the definition of the seats 61,65 for containing the pin-shaped ends 71,75 of the main hook 32 and of the tripping element 36 in the control mechanism 30, and also the connecting seat 122 for containing the shaped portions 121 of the trip shaft 40. From a practical standpoint, the moulding also makes it possible to define new forms of connection between the sides 134A,134C of the frame 31 and the elements in the kinematic chain. In the embodiment illustrated, for instance, the internal sides 134E of the sides 134A, 134C comprise a shaped ribbing 145 (see FIG. 22) that forms a seat 146 for the rotation of the pin-shaped end 35C of the lever-holder element 35. It is self-evident that, among the other advantages, this solution simplifies the design and manufacture particularly of the lever-holder element 35.

With reference in particular to the detailed view in FIG. 29, the frame 31 is moulded from a plastic material so as to create "pinched areas" 155 coming between each side 134A,134C of the frame 31 and the connecting portion 21 that provides the transverse connection between the two sides 134A,134C. The term "pinched area" is used here to mean a local thinning of the material so as to enable one side 134 to be folded over in relation to the transverse connecting portion 21, or vice versa, as shown clearly in FIGS. 25 and 26. In other words, the pinched area 155 serves as a structural hinge enabling the frame 31 to be folded after moulding, as shown in FIGS. 23 and 24, to shape it into the operative condition shown, for instance, in FIGS. 17 and 19. The pinched areas 155 are naturally designed so as to assure a certain mechanical resistance, sufficient to counter any stresses tending to separate the sides 134A,134C of the frame 31.

Figure 27:
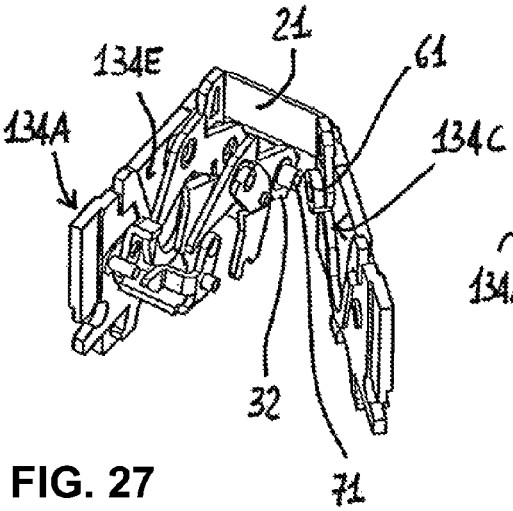
Figure 28:
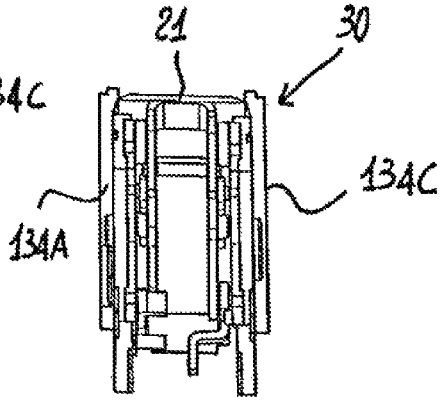

FIGS. 27 and 28 show the control mechanism 30 respectively during its assembly and after the completion of the assembly. Clearly, moulding the supporting frame 31 in one piece also simplifies the procedure for assembling the unit comprising the control mechanism 30 and the trip shaft 40. With reference in particular to FIG. 27, the elements comprising the kinematic chain in the mechanism 30 can be installed first on an internal side 134E of the first side 134A of the frame 31. Thus, for instance, one of the pin-shaped ends 71 of the main hook 32 can be inserted in one of the moulded seats 61 on the first side 134A. Then the second side 134C can be folded over in relation to the first 134A, thanks to the pinched areas 155, so as to block the elements of the kinematic chain on the other side too. As illustrated, the other pin-shaped end 71 of the main hook 32 can be inserted in the corresponding seat 61 so as to stably hold the hook on both sides and consequently all the elements connected thereto. Once the configuration shown in FIG. 28 has been obtained, the structure of the control mechanism 30 can be stiffened by connecting the trip shaft 40 according to the above-explained principles.

The technical solutions adopted for the circuit-breaking device according to the invention fully enable the previously-stated technical aim to be satisfied. In particular, the internal structure of the device is such that it enables a marked reduction in the assembly times by comparison with the conventional solutions. At the same time, the circuit-breaking device is reliable and easy to manufacture at extremely competitive costs.

The circuit-breaking device thus conceived may undergo numerous modifications and variants, all coming within the scope of the inventive concept. Moreover, all the details may be replaced by others that are technically equivalent and, in practical terms, any materials may be used of any suitable shape and size, according to need and the state of the art.

The invention claimed is:

1. A single-pole or multipolar low-voltage circuit-breaking device comprising:

an external housing containing, for each pole, at least one fixed contact and one moving contact suitable for mutually coupling and uncoupling;

a control mechanism comprising a supporting frame that supports a kinematic chain operatively connected to said moving contact so as to enable the latter to be coupled to and uncoupled from said fixed contact;

a trip shaft for activating said kinematic chain, said trip shaft comprising, for each pole, and operative portion, with which a protection unit of a protection device interacts;

wherein said supporting frame comprises a pair of facing sides connected together by means of a first transverse connecting portion and by further connection means that define a further transverse connecting portion in a different position from that of said first transverse connecting portion; and wherein said further connection means comprises said trip shaft.

2. A circuit-breaking device according to claim 1, wherein said first transverse connecting portion is made in one piece together with said sides.

3. A circuit-breaking device according to claim 1, wherein said further connection means provide a transverse connection between said sides such that said further transverse connecting portion occupies a position in front of said first transverse connecting portion.

4. A circuit-breaking device according to claim 1, wherein said sides are connected pivotally to said trip shaft.

5. A circuit-breaking device according to claim 4, wherein said sides are connected pivotally to said trip shaft by means of a pair of facing pin-shaped ends, each of which emerges from one of said sides, each pin-shaped end being inserted in a corresponding shaped cavity defined on said trip shaft, said shaped cavity comprising at least one recessed portion that has surfaces geometrically conjugated with those of said pin-shaped ends of said sides of the frame.

6. A circuit-breaking device according to claim 5, wherein said recessed portions are defined so that said pin-shaped ends occupy a position coaxial to the axis of rotation of said trip shaft, said recessed portions defining an abutment surface for a corresponding side of said frame.

7. A circuit-breaking device according to claim 4, wherein said trip shaft is pivotally connected to the sides of said supporting frame by means of a "keyed" connection, said keyed connection consisting of a pair of shaped portions of the trip shaft inserted in suitable connection seats defined on end portions of the sides of the frame.

8. A circuit-breaking device according to claim 1, wherein said supporting frame comprises pinched areas coming between each side of said frame and said first transverse connecting portion.

9. A circuit-breaking device according to claim 8, wherein said supporting frame is made of a plastic material.

* * * * *